US007546081B2

(12) United States Patent
Tokita et al.

(10) Patent No.: US 7,546,081 B2
(45) Date of Patent: Jun. 9, 2009

(54) PAPER FINISHER HAVING PAPER PERFORATING APPARATUS, AND IMAGE FORMING APPARATUS EQUIPPED WITH PAPER PERFORATING APPARATUS AND PAPER FINISHER

(75) Inventors: Junichi Tokita, Kanagawa (JP); Kenji Yamada, Tokyo (JP); Junichi Iida, Kanagawa (JP); Nobuyoshi Suzuki, Tokyo (JP); Naohiro Kikkawa, Tokyo (JP); Shingo Matsushita, Kanagawa (JP); Hiromoto Saitoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 461 days.

(21) Appl. No.: 11/267,403

(22) Filed: Nov. 7, 2005

(65) Prior Publication Data

US 2006/0120783 A1 Jun. 8, 2006

(30) Foreign Application Priority Data

Nov. 11, 2004 (JP) ..... 2004-327194
Sep. 9, 2005 (JP) ..... 2005-262416

(51) Int. Cl.
*G03G 15/00* (2006.01)

(52) U.S. Cl. ..... 399/407; 399/408; 399/409; 399/410; 270/58.08

(58) Field of Classification Search ..... 399/407, 399/408, 409, 410
See application file for complete search history.

(56) References Cited

U.S. PATENT DOCUMENTS 5,263,697 A 11/1993 Yamazaki et al.
5,508,798 A 4/1996 Yamada
5,758,252 A * 5/1998 Enomoto et al. ..... 399/407
5,762,328 A 6/1998 Yamada et al.
6,065,383 A * 5/2000 Takaishi et al. ..... 83/368

(Continued)

FOREIGN PATENT DOCUMENTS

JP 2003-212424 7/2003

OTHER PUBLICATIONS

JP Pub 2003-212424 machine translation.*

(Continued)

*Primary Examiner*—Daniel J Colilla
*Assistant Examiner*—Allister Primo
(74) *Attorney, Agent, or Firm*—Oblon, Spivak, McClelland, Maier & Neustadt, P.C.

(57) ABSTRACT

A paper perforating apparatus which can securely prevent a paper end portion from being caught in a punch hole, without having an assist member, such as mylar, in a paper finisher which comprises a perforating device capable of moving in a direction perpendicular to the paper conveyance direction, the paper perforating apparatus, comprising: a paper conveyance device for conveying a paper; a perforating device for perforating the paper; a paper end portion detecting device for detecting an end portion parallel to the conveyance direction of the paper; and a device for moving the perforating device in a direction perpendicular to the conveyance direction, wherein the paper perforating apparatus offsets a standby position of the perforating device, which is in the direction perpendicular to the paper conveyance direction, from a position in which holes are punched out on the paper by a predetermined distance, and the perforating device starts operation of perforation preparation from the standby position after being passed by a front end of the paper.

19 Claims, 17 Drawing Sheets

U.S. PATENT DOCUMENTS

| | | | |
|---|---|---|---|
| 6,145,825 | A | 11/2000 | Kunihiro et al. |
| 6,199,853 | B1 | 3/2001 | Andoh et al. |
| 6,231,045 | B1 | 5/2001 | Yamada et al. |
| 6,264,191 | B1 | 7/2001 | Suzuki et al. |
| 6,296,247 | B1 | 10/2001 | Tamura et al. |
| 6,322,070 | B2 | 11/2001 | Yamada et al. |
| 6,343,785 | B1 | 2/2002 | Yamada et al. |
| 6,394,448 | B2 | 5/2002 | Suzuki et al. |
| 6,416,052 | B2 | 7/2002 | Yamada et al. |
| 6,494,449 | B2 | 12/2002 | Tamura et al. |
| 6,494,453 | B1 | 12/2002 | Yamada et al. |
| 6,527,269 | B2 | 3/2003 | Yamada et al. |
| 6,549,734 | B2 | 4/2003 | Yamada et al. |
| 6,631,896 | B2 | 10/2003 | Yamada et al. |
| 6,698,744 | B2 | 3/2004 | Yamada et al. |
| 6,783,124 | B2 | 8/2004 | Tamura et al. |
| 6,905,118 | B2 | 6/2005 | Yamada et al. |
| 6,921,069 | B2 | 7/2005 | Suzuki et al. |
| 6,957,810 | B2 | 10/2005 | Yamada et al. |
| 2002/0135119 | A1 | 9/2002 | Suzuki et al. |
| 2003/0160376 | A1 | 8/2003 | Yamada et al. |
| 2003/0215275 | A1 | 11/2003 | Tamura et al. |
| 2003/0219295 | A1 | 11/2003 | Saitoh et al. |
| 2003/0234487 | A1 | 12/2003 | Tamura et al. |
| 2004/0051238 | A1 | 3/2004 | Yamada et al. |
| 2004/0104525 | A1 | 6/2004 | Suzuki et al. |
| 2004/0254054 | A1 | 12/2004 | Suzuki et al. |
| 2004/0256783 | A1 | 12/2004 | Iida et al. |
| 2005/0061131 | A1 | 3/2005 | Tamura et al. |
| 2005/0067777 | A1 | 3/2005 | IIda et al. |
| 2005/0082747 | A1 | 4/2005 | Tamura et al. |
| 2005/0206071 | A1 | 9/2005 | Suzuki et al. |
| 2005/0211035 | A1 | 9/2005 | Tamura et al. |
| 2005/0225021 | A1 | 10/2005 | Yamada et al. |
| 2006/0120783 | A1 | 6/2006 | Tokita et al. |

OTHER PUBLICATIONS

U.S. Appl. No. 11/682,238, filed Mar. 5, 2007, Iida et al.
U.S. Appl. No. 11/130,075, filed May 17, 2005, Shingo Matsushita.

* cited by examiner

NORTH AMERICA 3-HOLE PUNCHING

EUROPEAN 4-HOLE PUNCHING

PAPER FINISHER HAVING PAPER PERFORATING APPARATUS, AND IMAGE FORMING APPARATUS EQUIPPED WITH PAPER PERFORATING APPARATUS AND PAPER FINISHER

BACKGROUND OF THE INVENTION

1. Field of the Invention

The present invention relates to a paper finisher which is integrated with, fixed on, or provided separately in an image forming apparatus such as a printer, copying machine, and facsimile machine, and performs predetermined processing on a recording medium which is discharged from the image forming apparatus. Particularly, the present invention relates to a paper perforating apparatus having perforating means for forming perforated holes on a recording medium.

2. Description of the Related Art

There has been developed numbers of paper finishers which perform processing such as sorting, stapling, folding, and perforating on papers which are discharged from an image forming apparatus such as a copying machine and printer. Regarding the perforating processing (referred to as "perforating processing" hereinafter) performed by these finishers, there is generally known a pressing method for forming perforated holes (punch holes) on papers one by one that are being conveyed. Recently, numbers of perforating apparatuses that can form various types of punch wholes (on different positions and with different hole diameters) are provided. Further, in order to improve the accuracy of jogging the papers when bundling the papers, there are further provided perforating apparatuses which are configured so as to be able to move perforating means thereof toward conveyed papers in a direction perpendicular to the paper conveyance direction.

The known forms of perforated holes are a 3-hole punching, which is generally used in North America (referred to as "North America 3-hole punching" hereinafter), and a form of 4-hole punching, which is used in Europe (referred to as "European 4-hole punching" hereinafter). In the North America 3-hole punching, each hole has a hole diameter of 8 mm and a punch-hole pitch of 108 mm. On the other hand, in the European 4-hole punching, each hole has a hole diameter of 6.5 mm, and the punch-hole pitch thereof is set such that two holes are formed on an inner side that is 40 mm distant from the center line of a sheet of paper, and another two holes are formed on the outer sides that is 80 mm distant from these two inner holes. As described hereinbefore, many perforating means that can respond to different hole positions and different hole diameters.

In the case where the abovementioned North America 3-hole punching is used as the perforating means of the paper finisher so as to be made capable of moving as described above, when setting a home position of the perforating means to a position for forming punch holes on a paper, that is, a position in which the center of each hole to be punched and the center of the conveyance direction of the paper fit together, and when conveying the paper, which is a LT (letter) size (8.5 inches×11 inches) paper widely used in North America, in a longitudinal direction, that is, in a way that the longitudinal direction and the conveyance direction of the paper are parallel to each other, a side end of the paper passes over two holes that are positioned on the outer sides of the three holes, thus the side end is caught in these holes, causing jams and curled edges many times. Similarly, in the case of the perforating means in which the European 4-hole punching is used, if a home position of the perforating means is set to a position where punch holes are formed on a paper, when conveying the paper, which is a B4 size paper widely used in Europe, in a longitudinal direction, that is, in a way that the longitudinal direction and the conveyance direction of the paper are parallel to each other, a side end of the paper passes over the holes that are positioned on the outer sides, thus the side end is caught in these holes, causing jams and curled edges.

As a measure against the above-described problems, there is proposed a method for guiding a paper end portion to the vicinity of the holes where a side end of the paper is caught, by means of a mylar sheet or the like. For example, Japanese Patent Application Laid-Open No. H7-186098 discloses a paper perforating apparatus which comprises guiding means for guiding papers in a predetermined direction, a perforating blade provided in the guiding means and punching holes on the papers, a conveyance roller provided on the downstream side of the perforating blade and constantly conveying the papers, drive means for driving the perforating blade, and idling control means for causing the drive means to operate so as to drive the perforating blade during a specific period of time when no paper is present in a perforation position in the guiding means. Accordingly, the guiding means is prevented from having the perforation position therein in a state where the perforating blade is driven incompletely, and jams that are caused by a paper being caught by the perforating blade can be prevented.

However, even when using such means, jams or curled edges may be generated depending on conditions of the paper (where the paper has a small curvature, etc), thus the above-described problems have not yet been resolved completely.

SUMMARY OF THE INVENTION

Therefore, the present invention is contrived in view of such circumstances of the conventional technology, and an object of the present invention is to provide a paper perforating apparatus which can move perforating means thereof in a direction perpendicular to the paper conveyance direction, and can securely prevent a paper end portion being caught in a punch hole without comprising an assist member such as mylar, a paper finisher having the paper perforating apparatus, and an image forming apparatus equipped with the paper perforating apparatus and paper finisher.

In accordance with an aspect of the present invention, a paper perforating apparatus comprises a paper conveyance device for conveying a paper; a perforating device for perforating the paper conveyed by the paper conveyance device; a paper end portion detecting device for detecting an end portion parallel to the conveyance direction of the paper conveyed by the paper conveyance device and a moving device for moving the perforating device in a direction perpendicular to the conveyance direction on the basis of detected information of the paper end portion detecting device. The paper perforating apparatus offsets by a predetermined distance a standby position of the perforating device, which is in the direction perpendicular to the paper conveyance direction, from a position in which holes are punched out on the paper, and the perforating device starts operation of perforation preparation from the standby position after a front end of the paper passes the perforating device.

In accordance with another aspect of the present invention, a paper finisher comprises a paper perforating apparatus. The paper perforating apparatus comprises a paper conveyance device for conveying a paper; a perforating device for perforating the paper conveyed by the paper conveyance device; a paper end portion detecting device for detecting an end portion parallel to the conveyance direction of the paper conveyed by the paper conveyance device; and a moving device for moving the perforating device in a direction perpendicular to the conveyance direction on the basis of detected information of the paper end portion detecting device. The paper perforating apparatus offsets by a predetermined distance a standby position of the perforating device, which is in the direction perpendicular to the paper conveyance direction, from a position in which holes are punched out on the paper, and the perforating device starts operation of perforation preparation from the standby position after a front end of the paper passes the perforating device.

In accordance with another aspect of the present invention, an image forming apparatus comprises an image supporting body which supports a latent image; a charging device for charging a surface of the image supporting body; an exposing device for exposing the charged surface of the image supporting body to light on the basis of image data, and writing an electrostatic latent image; a developing device for supplying a toner to a latent image formed on the surface of the image supporting body and making the latent image visible; a transferring device for transferring the visible image formed on the surface of the image supporting body to a transferred body; and a paper finisher having a paper perforating apparatus. The paper perforating apparatus comprises a paper conveyance device for conveying a paper; a perforating device for perforating the paper conveyed by the paper conveyance device; a paper end portion detecting device for detecting an end portion parallel to the conveyance direction of the paper conveyed by the paper conveyance device; and a moving device for moving the perforating device in a direction perpendicular to the conveyance direction on the basis of detected information of the paper end portion detecting device. The paper perforating apparatus offsets by a predetermined distance a standby position of the perforating device, which is in the direction perpendicular to the paper conveyance direction, from a position in which holes are punched out on the paper, and the perforating device starts operation of perforation preparation from the standby position after a front end of the paper passes the perforating device.

BRIEF DESCRIPTION OF THE PREFERRED EMBODIMENTS

The above and other objects, features and advantages of the present invention will become more apparent from the following detailed description taken with the accompanying drawings in which.

DESCRIPTION OF THE PREFERRED EMBODIMENTS

Each embodiment of the present invention is not described in detailed with reference to the figures hereinafter.

Figure 1:
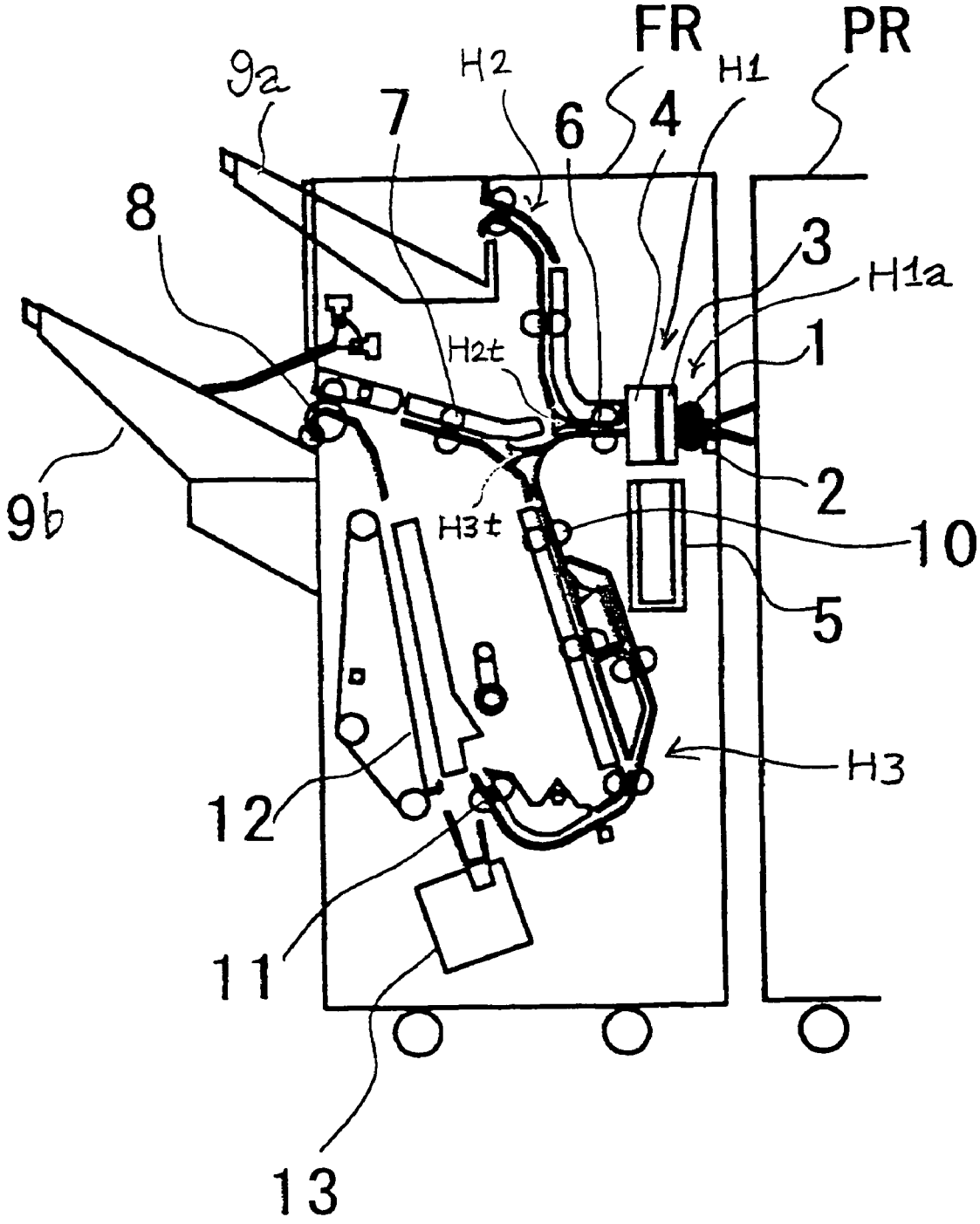
FIG. 1 is a figure showing an entire schematic configuration of a paper finisher which comprises a perforating apparatus for receiving a paper conveyed from an image forming apparatus and punching a hole on the paper.
Figure 2:
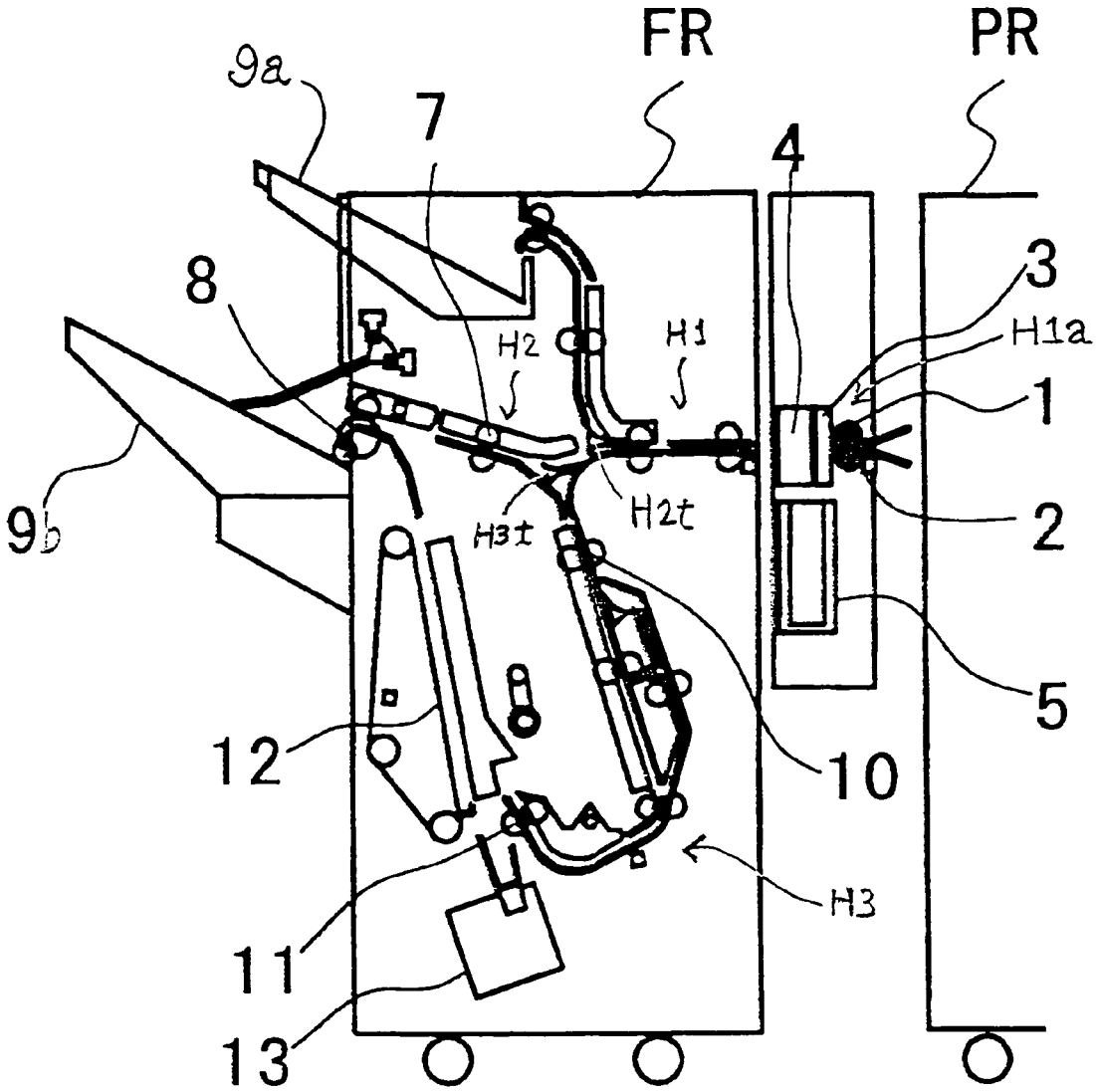
FIG. 2 is a figure showing an entire schematic configuration of a paper finisher which comprises a perforating apparatus for receiving a paper conveyed from an image forming apparatus and punching a hole on the paper.

First, FIG. 1 and FIG. 2 show an entire configuration of a paper finisher which comprises a perforating apparatus for receiving a paper conveyed from an image forming apparatus and punching a hole on the paper.

In FIG. 1, the perforating apparatus is embedded inside the paper finisher, and, in FIG. 2 the paper finisher is equipped with a punching apparatus at its upstream.

In FIG. 1, the paper finisher FR basically comprises a perforating unit (called "punch unit" hereinafter) 4, a horizontal conveyance path H1, an upper conveyance path H2, a lower conveyance path H3, a stapling processing tray 12, and two upper and lower catch trays 9*a*, 9*b*. The horizontal conveyance path H1 is provided with a first branch nail H2*t* for witching the conveyance path to the upper conveyance path H2, and a second branch nail H3*t* for switching the conveyance path to the lower conveyance path H3. The lower conveyance path H3 is provided with the stapling processing tray 12, and a lower end portion of the stapling processing tray 12 is equipped with a stapler 13 so that a sheaf of papers is collected on the stapling processing tray 12 and stapling processing can be performed on a back end portion of the bundled papers. The lower conveyance path H3 is further provided with a paper holding path so that a paper which is sent previously from an image forming apparatus PR is held temporarily, stacked on a paper which is sent subsequently, and conveyed to the stapling processing tray 12 side. The sheaf of papers that are subjected to stapling processing are discharged from the stapling processing tray 12 to the lower catch tray 9*b* by a discharge belt and a discharge roller 8 via a discharge nail.

The upper catch tray 9*a* is also called "proof tray," and is used when discharging a paper which is not subjected to any processing. It should be noted that a paper is conveyed to the upper catch tray 9*a* by turning the first branch nail H2*t* provided in the horizontal conveyance path H1 downward (clockwise direction in the figures) and opening the horizontal conveyance path on the upper conveyance path H2 side.

The lower catch tray 9*b* functions as a shift tray, and is capable of grouping papers by section when sorting and stacking the papers. Grouping is performed by moving the lower catch tray 9*b* in a direction perpendicular to the paper conveyance direction by a predetermined amount for each section, and causing the lower catch tray 9*b* to reciprocate so that a first section and a subsequent section are not aligned by the predetermined amount. In this case, the first and second branch nails H2*t* and H3*t* are turned, and the horizontal conveyance path H1 is opened to a discharge outlet to the lower catch tray 9*b*. It should be noted that the lower catch tray 9*b* moves downward as a paper or a sheaf of papers are discharged and a load of papers increases. This movement happens on the basis of a detected output of a paper detector which detects a surface position of the uppermost paper stacked on the lower catch tray 9*b*.

Figure 3:
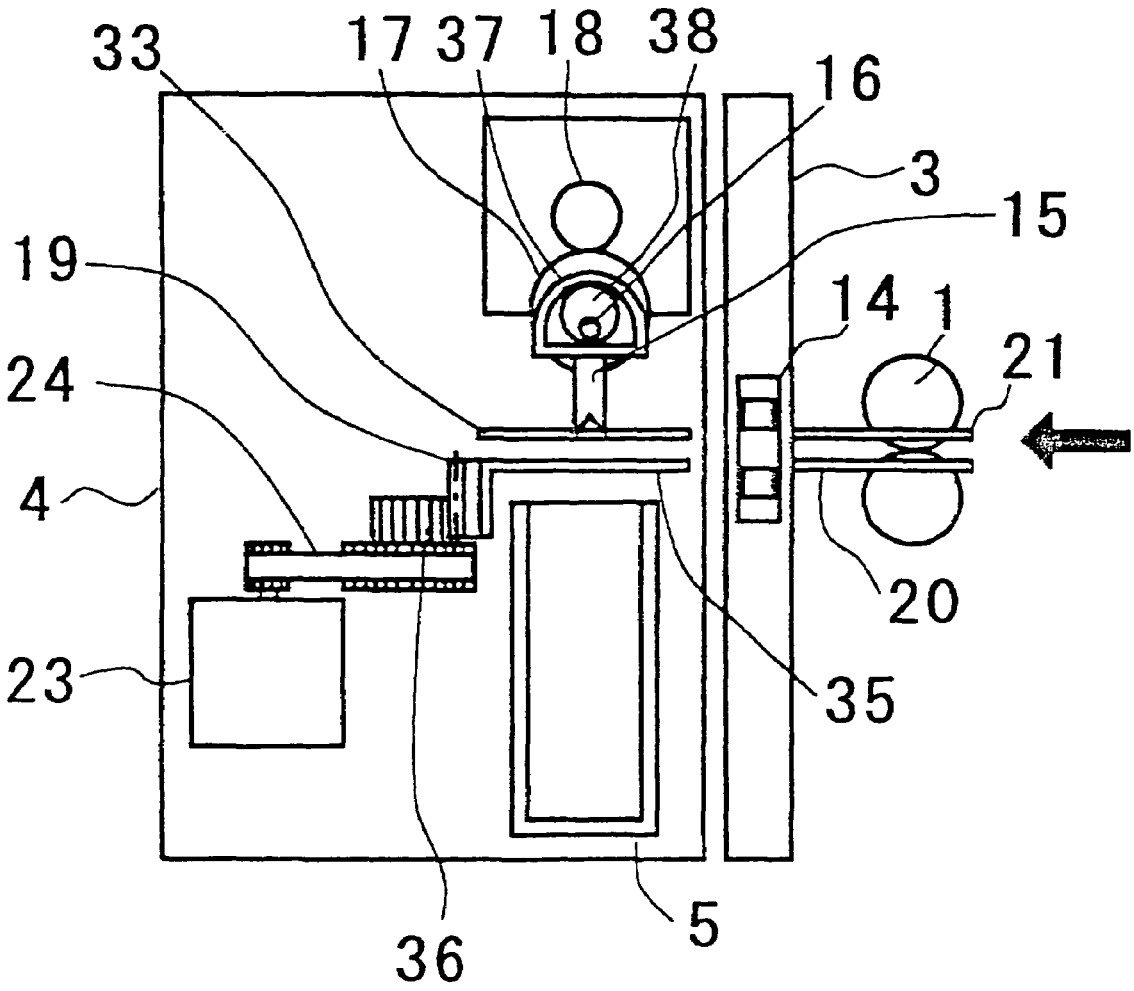
FIG. 3 is a figure showing an entire schematic configuration of a horizontal resist detecting unit and a perforating unit related to a first embodiment of the present invention.
Figure 4:
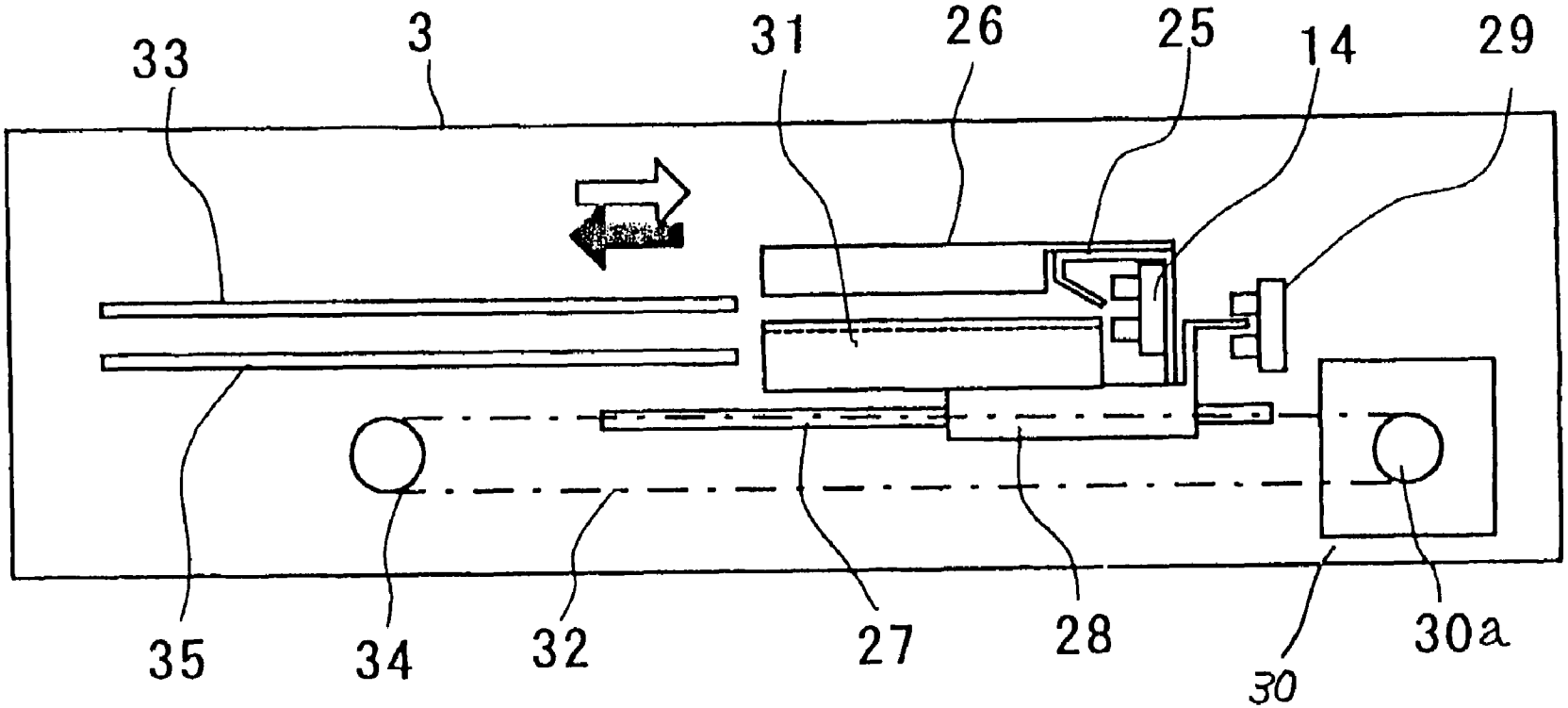
FIG. 4 is a cross sectional view of the horizontal resist detecting unit related to the present embodiments.
Figure 5:
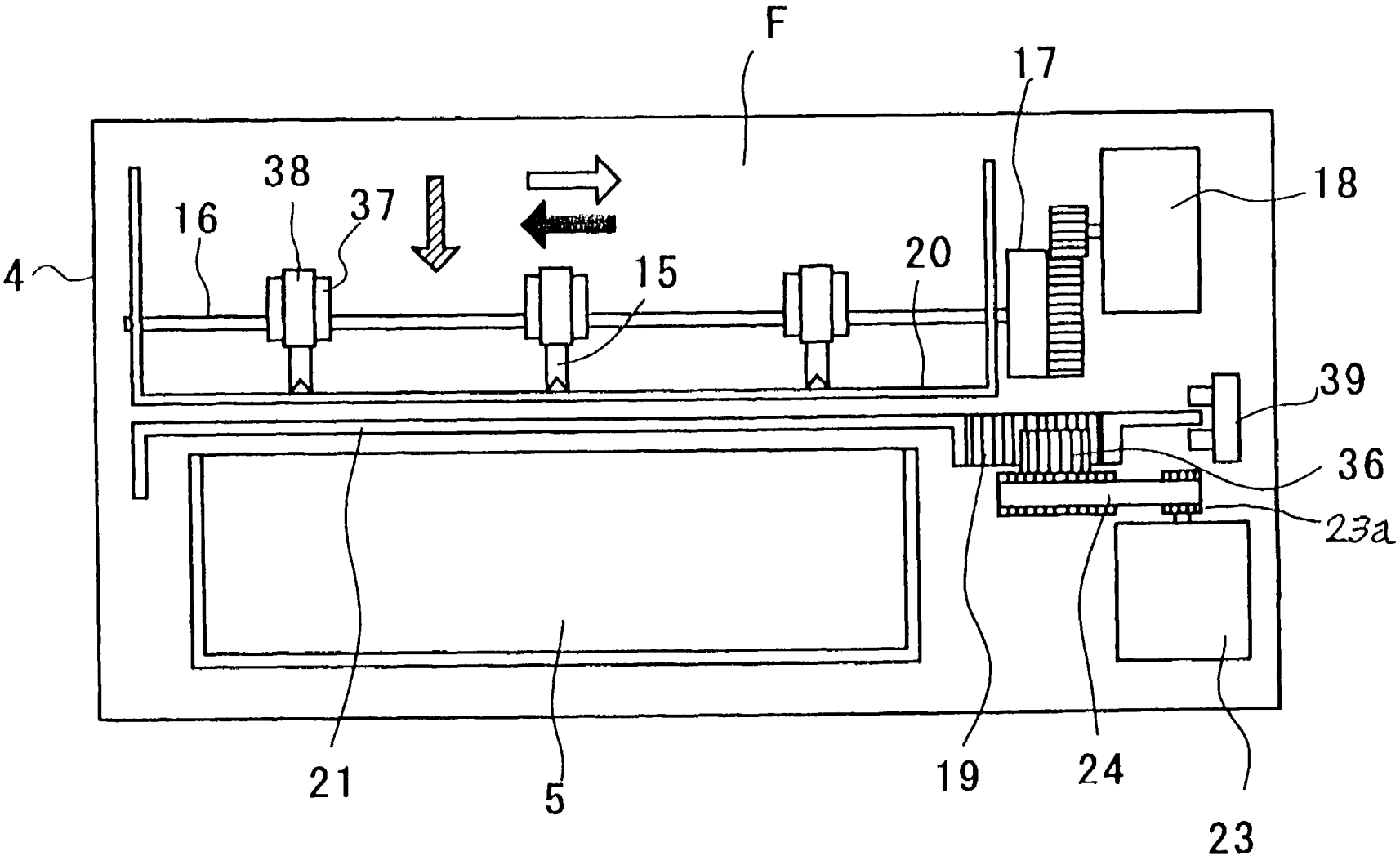
FIG. 5 is a cross sectional view of the perforating apparatus related to the present embodiments.

It should be noted that FIG. 2 shows an example in which the perforating apparatus is provided on a path that reaches from the image forming apparatus to the paper finisher FR, that is, an upstream side of the paper conveyance direction of the paper finisher FR. In this modified example, a paper end portion detecting unit 3 and a perforating unit 4 which are shown in FIG. 3 through FIG. 5 hereinafter are provided separately between the image forming apparatus PR and the paper finisher FR to configure a single system. This system is same as the image forming apparatus PR of FIG. 1, except that the system is provided with an entrance roller H1*a* on the uppermost stream in the horizontal direction of the horizontal conveyance path H1 of the paper finisher FR.

The image forming apparatus PR forms a visible image on a recording medium (paper) on the basis of image information which is input or read by a scanner. The image forming apparatus PR is a so-called electrophotographic type image forming apparatus which comprises: for example, an image processing apparatus which executes a predetermined image processing such as converting the image information to writable image information; an optical writing apparatus, for example, which writes an image on a photoconductor on the basis of the converted writable image information; a development apparatus which develops, by means of a toner, a latent image formed on the surface of the photoconductor by the optical writing apparatus; a transfer apparatus which transfers the developed visible image (toner image) onto a paper which is the recording medium; a separator which separates the paper on to which the image is transferred by the transfer apparatus from the photoconductor; a fixing apparatus which fixes the transferred toner image onto the surface of the paper which is separated by the separator; a cleaner which removes the toner remained on the photoconductor; and a neutralization apparatus which neutralizes residual charges on the surface of the photoconductor. The electrophotographic type image forming apparatus itself is known, thus detailed explanation and illustration thereof are omitted here. It should be noted that, besides this type of image forming apparatus, known apparatuses an inkjet type, ink ribbon type, and letter press printing type can all be used.

Next, configurations of the perforating means related to a first embodiment of the present invention are described with FIG. 3 through FIG. 5.

FIG. 3 is a schematic configuration diagram showing an entire configuration of a horizontal resist detecting unit and a perforating unit related to the embodiment of the present invention. FIG. 4 is a cross sectional view of the horizontal resist detecting unit 3. FIG. 5 is a cross sectional view of the perforating apparatus 4. It should be noted that FIG. 4 is an explanatory diagram showing paper end portion detecting operation performed by the horizontal resist detecting unit 3, and FIG. 5 is an explanatory diagram showing perforated hole position adjustment and an operation of perforation which are performed by the perforating apparatus 4.

As shown in FIG. 1 through FIG. 3, the uppermost stream of the horizontal conveyance path H1 is provided with a pair of skew correction rollers 1 that function as a pair of entrance rollers of the paper finisher FR, an entrance detector 2 as paper detecting means, the horizontal resist detecting unit 3, the perforating apparatus 4 as the perforating means, and a hopper 5. The horizontal resist detecting unit 3 is provided on an upstream side in the paper conveyance direction of the perforating unit (paper perforating apparatus), and a further upstream side in the paper conveyance direction of the horizontal resist detecting unit 3 is provided with a punching upper guide 21 and a punching lower guide 20, the horizontal resist detecting unit 3 is provided with a paper end portion detector 14 as paper end portion detecting means for detecting a position of the end portion which is parallel to the paper conveyance direction.

The perforating unit 4 comprises: a punching blade 15 as the perforating means; a holder 37 provided integrally on an upper end portion of the punching blade 15; a cam 38 which is inserted into the holder 37 and engaged with a decentered axis 16; a motor 18 which drives the punching blade 15 by means of a clutch 17; a second stepping motor 23 which moves the punching blade 15 in a direction perpendicular to the paper conveyance direction; a timing belt 24, a gear/pulley 36, rack 19, a fixed upper guide 33, and a fixed lower guide 35. A paper guide is configured such that an upper guide 26, which moves as the paper end portion detector 14 moves to the left as shown with an arrow in FIG. 4, overlaps with the fixed upper guide 33, and a lower guide 31 overlaps with the fixed lower guide 35.

In the paper finisher FR which is configured as described above, first, a front end of a paper conveyed from the image forming apparatus PR is caused to abut on nips of the pair of skew correction rollers 1 which are not moving. For a certain period of time, after the abutted paper is bent by a proper amount, the pair of skew correction rollers 1 are rotated, and conveyance of the paper is started again. Stopping the pair of skew correction rollers 1 and rotating them are triggered by detection of the front end of the paper, which is performed by the entrance detector 2. The paper which has been subjected to skew correction by the skew correction rollers 1 passes the horizontal resist detecting unit 3 next, and thereafter passes the perforating unit 4.

The paper end portion detector 14, which detects a position of an end portion which is parallel to the conveyance direction of the paper conveyed to the horizontal resist detecting unit 3, is capable of moving in the direction perpendicular to the conveyance direction (leftward direction as shown in FIG. 4). As can be understood from FIG. 4, the paper end portion detector 14 is attached to a paper guide 25, and the paper guide 25 is attached to a holder 28. The holder 28 moves in the direction perpendicular to the paper conveyance direction (right and left directions in the figure) while sliding on an axis 27.

The holder 28 is engaged with a timing belt 32, which then extends between a drive pulley 30*a* of a first stepping motor 30 and a driven pulley 34, and rotary moves between the both pulleys 30*a* and 34 by rotation of the first stepping motor 30, whereby the holder 28, the paper guide 25, and the paper end portion detector 14 can be caused to reciprocate in the direction perpendicular to the paper conveyance direction. Further, a home position (standby position) HP of the paper end portion detector 14 is determined by a home position detector 29 detecting a part of the shape of the holder 28. The paper end portion detector 14 stands by at this standby position, slides along the axis 27 in accordance with the rotation of the timing belt 32, taking the first stepping motor 30 as a drive source, and moves to the left as shown, in the figure in order to detect a paper end portion S1 which is parallel to the paper conveyance direction.

Figure 6:
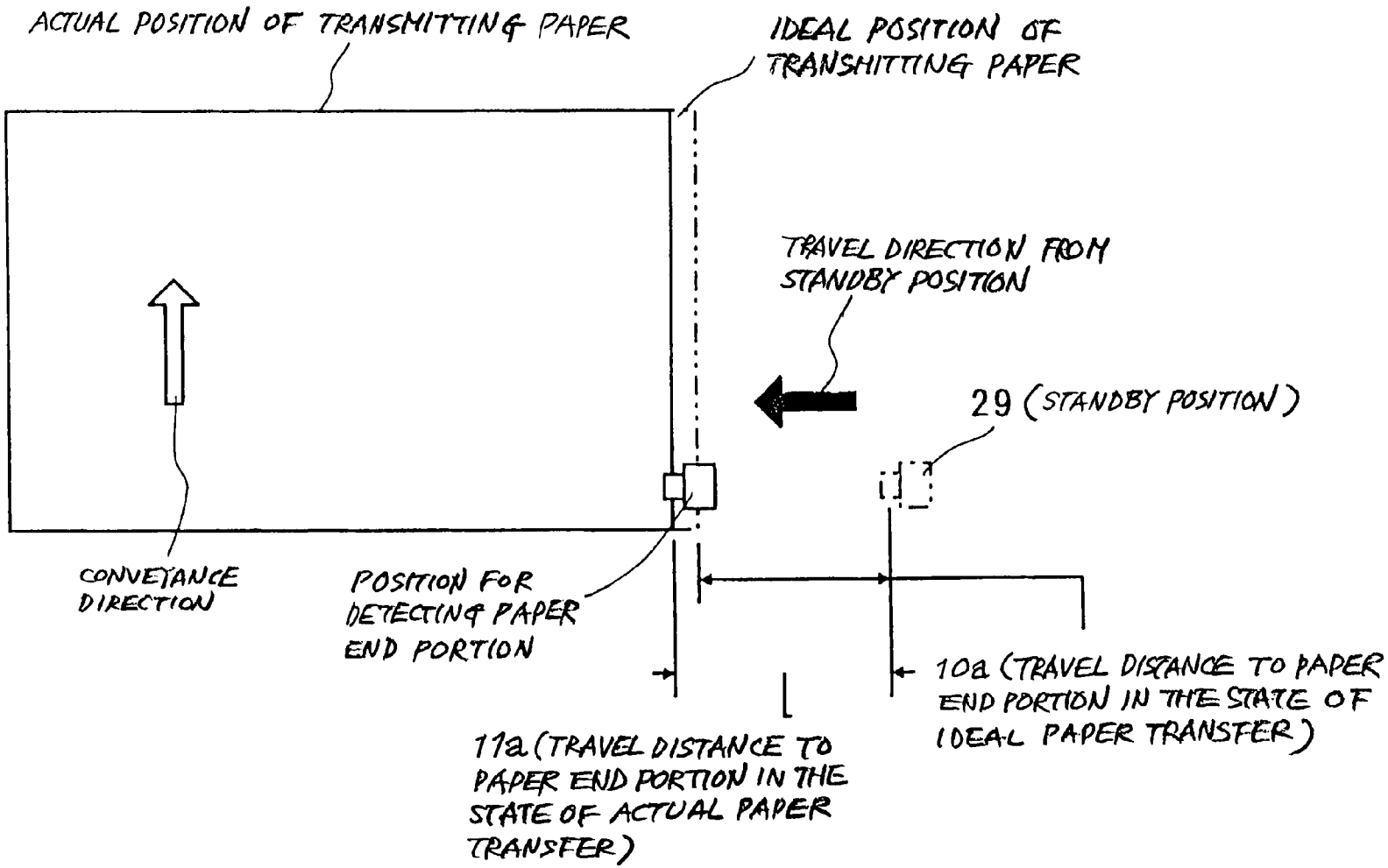
FIG. 6 is a figure for explaining paper end portion detecting operation performed by the horizontal resist detecting unit.

Here, FIG. 6 is used to explain a state in which deviation of the paper conveyance direction is detected.

FIG. 6 is a figure for explaining paper end portion detecting operation performed by the horizontal resist detecting unit 3. Here, travel distance of the paper end portion detector 14 for a single pulse of the first stepping motor 30 is a. At this time, for example, assuming that the paper S is conveyed to an ideal position without a horizontal resist deviation generated on the paper S to be conveyed, travel distance w of the paper end portion detector 14 from its standby position HP to a position for detecting an end portion SE which is parallel to the conveyance direction of the paper S is 10*a*. When the travel distance of the detector 14 to the position for detecting the end portion parallel to the conveyance direction of the conveyed paper S actually becomes 11*a*, it means that horizontal resist deviation of 11*a*−10*a*=1*a* . . . Equation 1 is generated. Therefore, it is necessary to move the punching blade 15, which is the perforating means, in the direction perpendicular to the paper conveyance direction (in the leftward direction shown with an arrow in FIG. 5) so as to correct the deviation amount of 1*a*.

On the other hand, when perforating by means of the perforating unit 4 which is configured by the parts described above, perforation operation is performed in a manner described hereinbelow.

First, up and down movement of the punching blade 15 of the perforating unit 4, that is, operation for punching holes on the paper S, is performed by drive from the motor 18. In this case, the axis 16 is rotated once by the motor 18 via the one-rotation clutch 17. The one-rotation clutch 17 is turned ON after a back end of the conveyed paper passes the entrance detector 2 and a fixed amount of time has elapsed. When the axis 16 is rotated, the cam 38 engaged with the decentered axis 16 rotates, and the holder 37 is caused to move up and down (in the direction shown with the arrow in FIG. 5). The punching blade 15 is caused to move up and down by this up and down movement of the holder 37, and a punch hole is formed on the paper S during a movement in a downward direction.

It should be noted that the perforating unit 4 of this embodiment is described as a press-and-punch type unit which stops the conveyance of paper once and to punch a hole. However, in the present embodiment, the perforating unit can be applied in rotary punching in which the punching blade and a die are provided in a rotation body, and a hole is punched while combining the punching blade 15 and die by the rotation of the rotation body and conveying a paper.

When punching a hole in this manner described above, it is necessary to position the punching blade 15 which is the perforating means by causing it to move in the direction perpendicular to the paper conveyance direction (the right and left directions in FIG. 5) in accordance with the deviation. Moving the punching blade is performed with the second stepping motor 23 as the drive source, and the gear/pulley 36 is rotated after transmission from a drive pulley 23*a* of the second stepping motor 23 to the gear/pulley 36 via the timing belt 24. The gear of the gear/pulley 36 is engaged with the rack 19, which is caused to move in the directions shown with the right and left arrows in FIG. 5 by the rotation of the gear/pulley 36. The rack 19 is attached to the fixed lower guide 35, while all the components such as the punching blade 15, a punching upper guide 21, the axis 16, cam 38, holder 37, clutch 17, motor 18, and the like (referred to as "perforating component F" hereinafter) for punching holes are attached to the fixed upper guide 33, and the fixed upper guide 33 and the fixed lower guide 35 are coupled to each other, thus the perforating component F are moved in the direction perpendicular to the paper conveyance direction by movement of the rack 19.

Figure 7A:
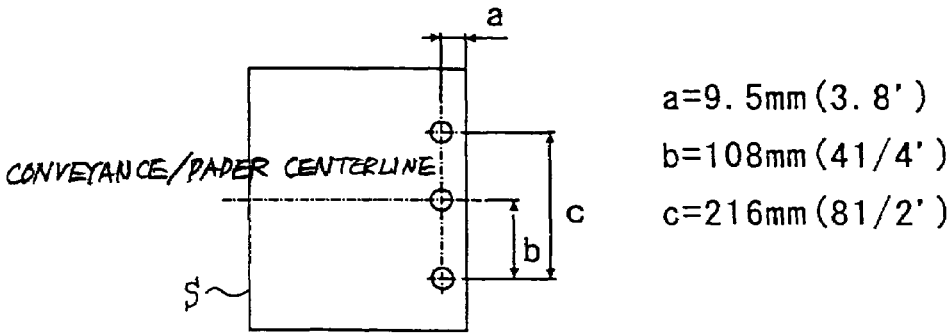
FIG. 7A is a figure showing the positional relationship among punch holes of a North America 3-hole punching unit.
Figure 7B:
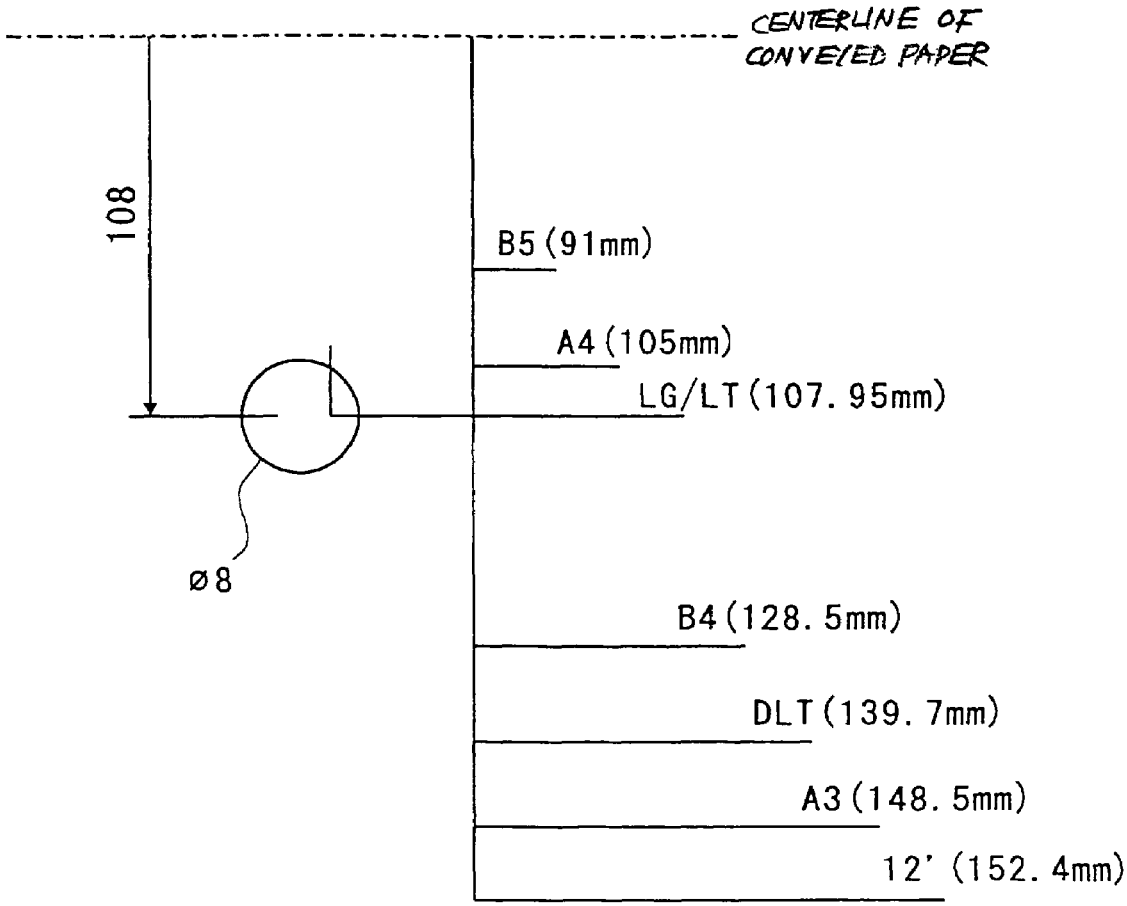
FIG. 7B is a figure showing the positional relationship between the punch hole positioned on the outer side and the paper size.

Here, FIGS. 7A and 7B are used to explain a case in which the perforating unit 4 is configured by means of the North America 3-hole punching (referred to as "North America 3-hole punching unit" hereinafter).

FIGS. 7A and 7B are figures for explaining punch holes made by the North America 3-hole punching unit, where FIG. 7A shows the positional relationship among the punch holes, and FIG. 7B shows the positional relationship between the punch hole positioned on the outer side and the paper size. As shown in FIG. 7A, the North America 3-hole punching unit punches holes such that three punch holes having a diameter of 8 mm are formed in a position away from side end portion perpendicular to the conveyance direction of the paper S by a distance a of 9.5 mm, with a punch-hole pitch of 108 mm therebetween. When taking the configuration in which the perforating unit 4 can move toward a paper to be conveyed, in the direction perpendicular to the paper conveyance direction, and when a LT-size paper is conveyed in a longitudinal direction, that is, in a way that the longitudinal direction and the conveyance direction of the paper are parallel to each other, a front end portion of the paper passes over holes P1 (two of the three holes, which are positioned on the outer sides on the paper). This thing can be said for an LG-size paper which has the same length of width, which is perpendicular to the longitudinal direction. It should be noted that description provided hereinafter explains an LT-size paper as an example.

In this case, when the LT-size paper is curled, the paper is sometimes caught in the holes on the outer sides among the three holes formed in the fixed upper guide 33 or fixed lower guide 35. This fact is explained using FIGS. 8A and 8B.

Figure 8B:
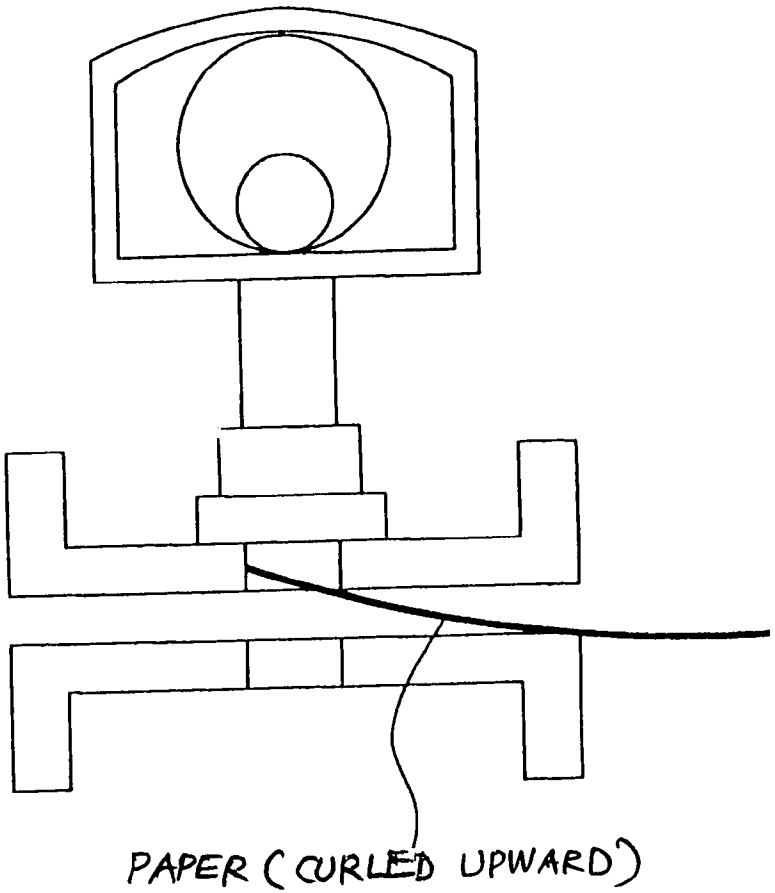
FIG. 8B is a figure showing a case in which the paper curves upward.
Figure 8A:
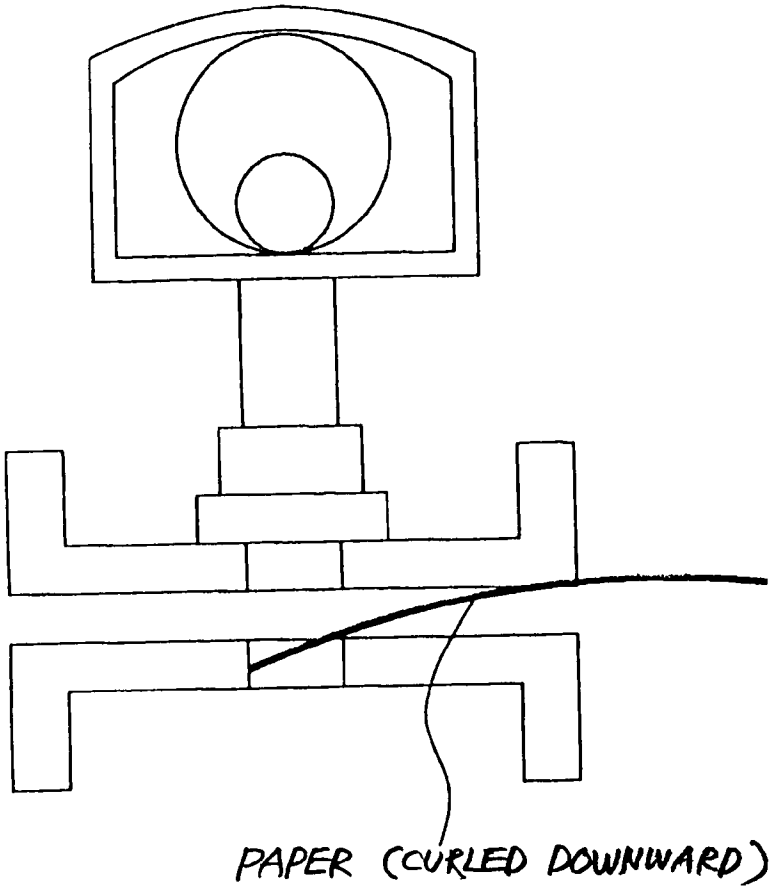
FIG. 8A is a figure showing a case in which a paper which curves downward is caught in a hole of a fixed upper guide or lower guide.

FIGS. 8A and 8B are figures showing a situation in which a curved paper is caught in a hole of the fixed upper guide or fixed lower guide, where FIG. 8A shows a case in which the paper curves downward, and FIG. 8B shows a case in which the paper curves upward. Specifically, if the LT-size paper S which has been conveyed is curved downward as shown in FIG. 8A, the front end portion of the paper S is caught in a hole 35*a* of the fixed lower guide 35 which corresponds to the holes P1 on the outer sides, causing jams and curled edges. Moreover, as shown in FIG. 8B, if the paper S is curved upward, the corners of the curved part are caught in a hole 33*a* of the fixed upper guide 33, causing jams and curled edges.

Figure 9:
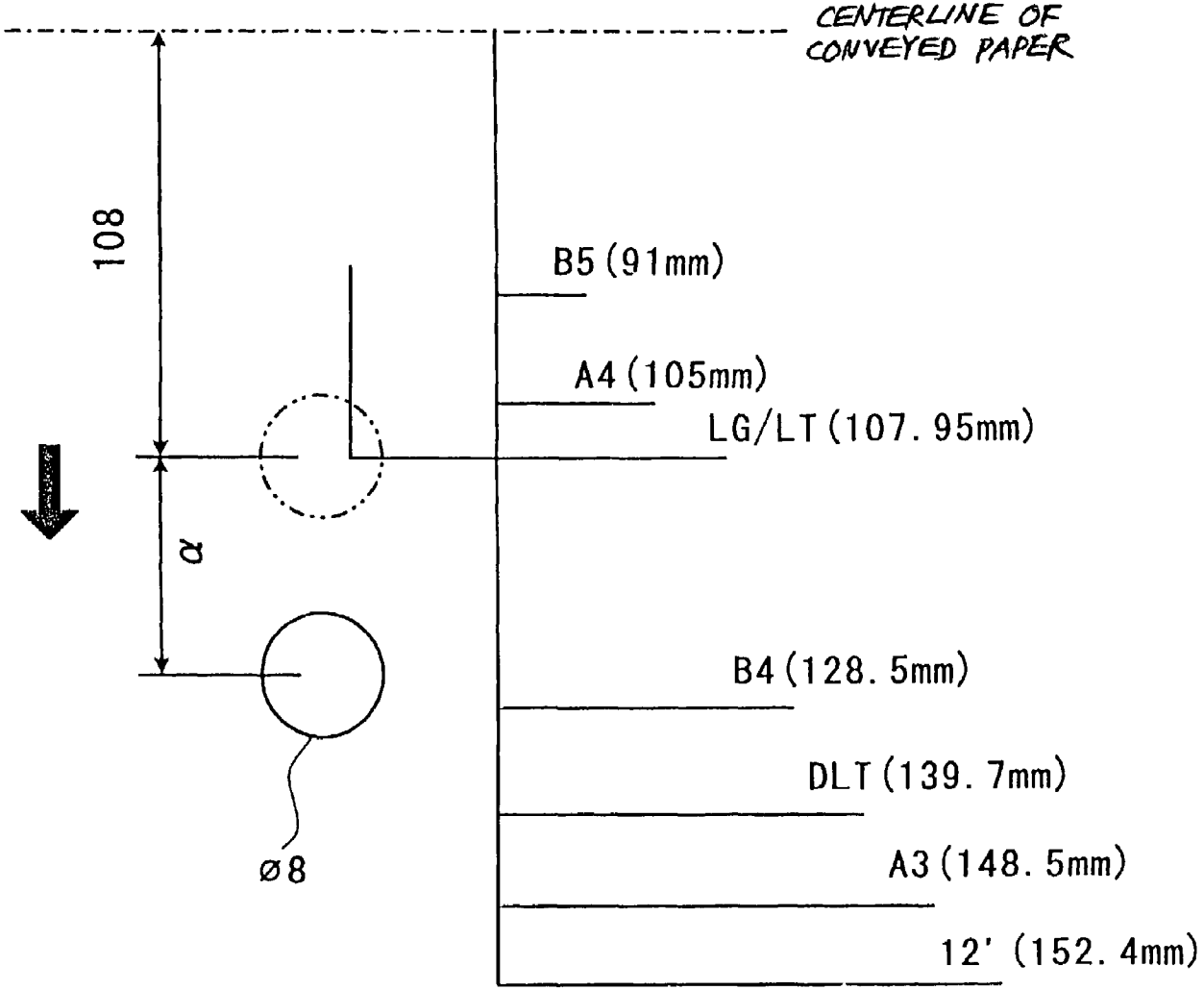
FIG. 9 is a figure showing the positional relationship among a punch hole positioned on the outer side, a home position of the punch hole, and the paper size.

Therefore, in the present embodiment, the home position of the perforating unit 4 is set as shown in FIG. 9. FIG. 9 shows the positional relationship among a punch hole positioned on the outer side, a home position of the punch hole, and the paper size. Specifically, the home position is set as a first position HP1 which is offset to the outer side by a predetermined distance α (approximately 10 mm) in a direction shown with an arrow, the first position being shown with a solid line, from a position of a hole shown with a chain double-dashed line (position shown with a solid line in FIG. 7), which is positioned when the perforating component F of the perforating unit 4 is caused to move in the direction perpendicular to the paper conveyance direction. Accordingly, a configuration in which an end portion of the LT-size paper does not pass over the punch hole can be formed, whereby occurrence of jams or curled edges can be prevented. It should be noted that α in the first position HP1 is set to 10 mm, as a specific example.

Figure 10A:
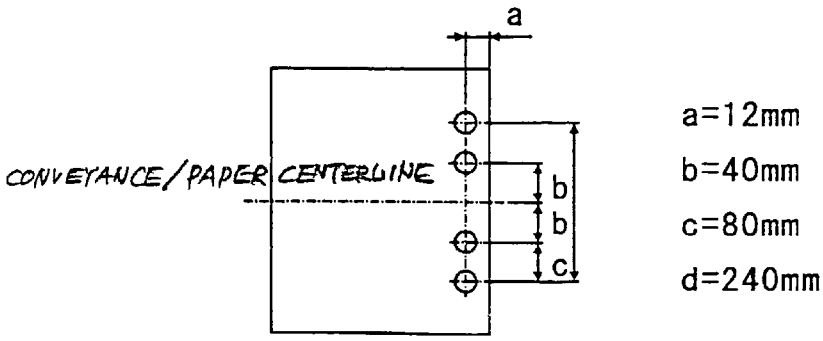
FIG. 10A is a figure showing the positional relationship among punch holes of a European 4-hole unit.
Figure 10B:
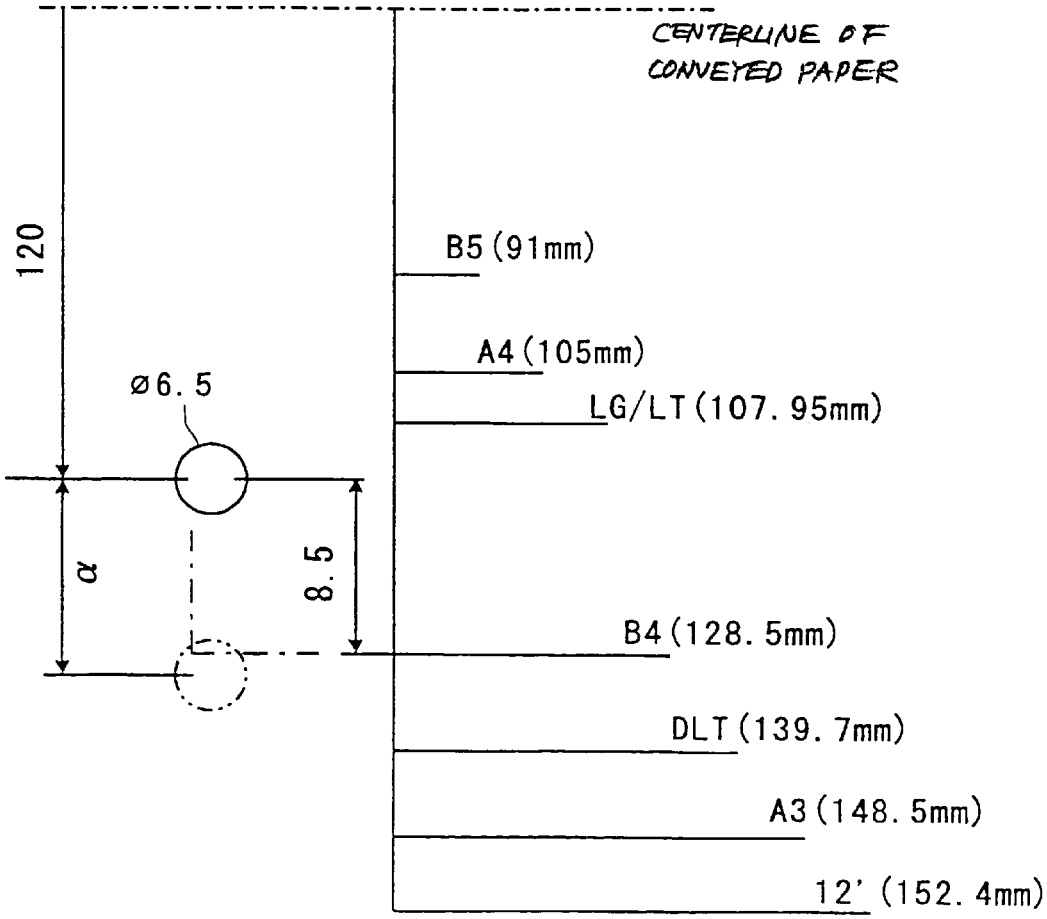
FIG. 10B is a figure showing the positional relationship between the punch hole positioned on the outer side and the paper size.

On the other hand, as the perforating unit 4, a perforating unit configured by means of the European 4-hole punching shown in FIGS. 10A and 10B (referred to as "European 4-hole punching unit" hereinafter) is sometimes used besides the abovementioned North America 3-hole punching unit. FIGS. 10A and 10B are figures for explaining punch holes formed by the European 4-hole punching unit, where FIG. 10A shows the positional relationship among the punch holes, and FIG. 10B shows the positional relationship between a punch hole positioned on the outer side and the paper size.

As shown in FIG. 10A, the European 4-hole punching unit punches holes such that four punch holes having a diameter of 6.5 mm are formed in a position away from side end portion perpendicular to the conveyance direction of the paper S by a distance a of 12 mm. The punch-hole pitch of the two holes on the inner side is positioned 40 mm, which is a distance b, away from the centerline of the conveyed paper, and the punch-hole pitch of the two holes on the outer side is positioned 80 mm, which is a distance c, away from the punch-holes on the inner side. The punch-hole pitch of the two punch holes on the outer side, which is the distance d, is 240 mm, and is positioned 120 mm away from the centerline of the conveyed paper direction. Therefore, when taking the configuration in which the perforating unit 4 can move toward a paper to be conveyed, in the direction perpendicular to the paper conveyance direction, and when the standby position obtained by offsetting the punch holes on the outer side is set such that the standby position is shifted toward the outer side by approximately a predetermined distance α=10 mm as in the North America 3-hole punching unit, as shown by chain double-dashed line in FIG. 10B, in the case where a B4-size paper is conveyed in a longitudinal direction, that is, in a way that the longitudinal direction and the conveyance direction of the paper are parallel to each other, a front end portion of the paper passes over a hole shown with a chain double-dashed line, which is positioned on the outer side.

Therefore, in the case of the European 4-hole punching unit, a second position HP2 which obtained by shifting the punch holes toward the inner side by a predetermined distance β (2 to 3 mm) in a direction opposite of the direction in the case of the North America 3-hole punching unit is set as the home position. Accordingly, even if the perforating component F of the perforating unit 4 is positioned on the home position, the end portion of the B4-size paper does not pass over the hole. In this manner, in the present embodiment, the home position is changed depending on the type of perforating unit. As a specific example, in the case of the European 4-hole punching unit, β in the second position HP2 is set to 2.5 mm.

It should be noted that, as a control configuration of he image forming system configured by the paper finisher FR and the image forming apparatus PR, a signal from each detector and switch inside the paper finisher FR is input to a CPU (not shown) via an I/O interface (not shown). The CPU controls the drive of a plurality of CD solenoids that drive the first and second branch nails H2*t* and H3*t*, a plurality of DC motors that move the lower catch tray 9*b* and the like, and a plurality of stepping motors that drive the pair of skew correction rollers 1 and a pair of conveyance rollers 6, in accordance with the signal input from the image forming apparatus PR or each detector switch. Moreover, the CPU controls the drive of a plurality of stepping motors that drive the stapler 13 via the I/O interface, is connected to the perforating unit 4, and controls the derive of the clutch 17 and the motor 18 by means of the signal from each detector switch such as the entrance detector 2 or the paper end portion detector 14. The CPU further controls the drive of the first and second stepping motors 30 and 23.

Here, suppose that travel distance of the perforating component F for a single pulse of the second stepping motor 23 is b. At this time, when the relationship between the travel distance a of the paper end portion detector 14 for a single pulse of the first stepping motor 30 of the horizontal resist detecting unit 3 and the abovementioned travel distance b is such that the distance a is approximately an integral multiple of the distance b (for example, two times), a=2×b . . . (Equation 2). If the horizontal resist of the papers is displaced by la as expressed in (Equation 1) described above, a horizontal resist deviation of 1 pulse is generated since the travel distance of the detector 14 for a single pulse is a. Therefore, in order to move the perforating component F, it is necessary to add an offset amount of α of the home position to the second stepping motor 23, and to input a pulse for a distance of 1*a*. The relationship between the travel distances for a single pulse is expressed in the equation of (Equation 2), thus the number of pulses that are input to the second stepping motor 23 is a sum of the offset amount α of the home position and a value which is two times larger than the number of pulses for the amount of deviation computed from the paper end portion detector 14.

Specifically, information on an end portion position which is obtained from the paper end portion detector 14 is recognized as a pulse, this information is compared to information on the size of paper width by means of the CPU, the amount of horizontal resist deviation of the paper is computed, a result of the computation is input as a pulse to the second stepping motor 23, and the perforating component F is moved. At this moment, the number of pulses to be input to the second stepping motor 23 is obtained from the equation (Equation 2), whereby errors occurring when moving by pulses can be reduced, and the accuracy of the perforating position can be improved. Moreover, regardless of the amount of deviation, the number of pulses that are input to the second stepping motor 23 for constantly moving the perforating configuration unit is expressed in the equation (Equation 2), thus control of software can be simplified.

Specifically, in the present embodiment, the amount of the horizontal resist deviation of the paper is computed by recognizing the information on an end portion position from the paper end portion detector 14 shown in FIG. 4, as a pulse, and comparing this information to the information on the size of paper width by means of the CPU, a result of the computation is input to the second stepping motor 23 as a pulse, and the perforating component F of the perforating unit 4 is moved. At this moment, the number of pulses to be input to the second stepping motor 23 is obtained from an equation, α+a (a=2×b: relational expression of the travel distance), whereby errors occurring when moving by pulses can be reduced, and the accuracy of the hole position can be improved. Moreover, regardless of the amount of deviation, the number of pulses that are input to the second stepping motor 23 for constantly moving the perforating component F is expressed in the equation, $\alpha$+a, thus control of software can be simplified.

As described above, the home position (standby positions) of the perforating component F in the direction perpendicular to the paper conveyance direction is offset by a predetermined distance from a position where punch holes are formed on the paper S, thus a front end portion of the paper S being conveyed can be prevented from being caught in the holes on the upper and lower guide plates, and occurrence of jams and curled edges can also be prevented. Moreover, the direction and distance of offsetting are changed depending on the type of formed punch holes, thus a front end portion of the paper S being conveyed can be prevented from being caught in the holes on the upper and lower guide plates, and occurrence of jams and curled edges on papers in different sizes can also be prevented.

It should be noted in the present embodiment that whether the offsetting needs to be performed or not is judged at a point of time when the front end of the paper S has reached the detecting means located on the upper stream side from the punch unit 4, that is, the entrance detector 2, for example. However, this judgment may be performed when the front end of the paper S has reached a discharge position in the image forming apparatus, in which case it is only necessary that information on the size of the paper is obtained when the front end of the paper S has reached the discharge position in the image forming apparatus.

It should be noted that, in order to improve the accuracy of a stop position of the perforating F, it is necessary to prevent back crash generated in the engaged rack 19 and gear 36. Therefore, in the present embodiment, when punching holes the perforating component F is once brought back to the position of a home position detector 29 (to the right, shown with the arrow in FIG. 5), and thereafter, in order to perform perforation again, the perforating component F is moved to hole formation positions (to the left, shown with the arrow in FIG. 5), which are determined on the basis of the information on the position of the paper S, which is obtained from the detector 39.

However, in a series of operations of preparation of perforation, if the perforating component F is brought back to the position of the home position detector 39 before the front end of the paper S passes the perforating component F, the front end of the paper S is caught in the holes on the upper and lower guide plates due to the curl formed on the paper, whereby jams and curled edges may occur.

Therefore, in the paper perforating apparatus 4 the timing at which the perforating component F is brought back to the home position detector 39 is when the front end of the paper S passes the perforating component F.

Judging whether or not the front end of the paper S has reached the perforating unit 4 can be performed by, for example, taking the motor for driving the skew correction rollers 1 as a stepping motor (referred to as "entrance motor" hereinafter), and thereby computing the travel distance of the front end of the paper from the entrance detector 2. Moreover, as a different method, there is a method of attaching a detector to the paper conveyance path. There is also a method of attaching the paper detecting means to the vicinity of the center of the perforating unit 4. In this case, however, the paper detecting means needs to be attached to a position where the sizes of all the conveyable papers S can be detected, that is, the vicinity of the center of the punch unit 4.

Figure 11A:
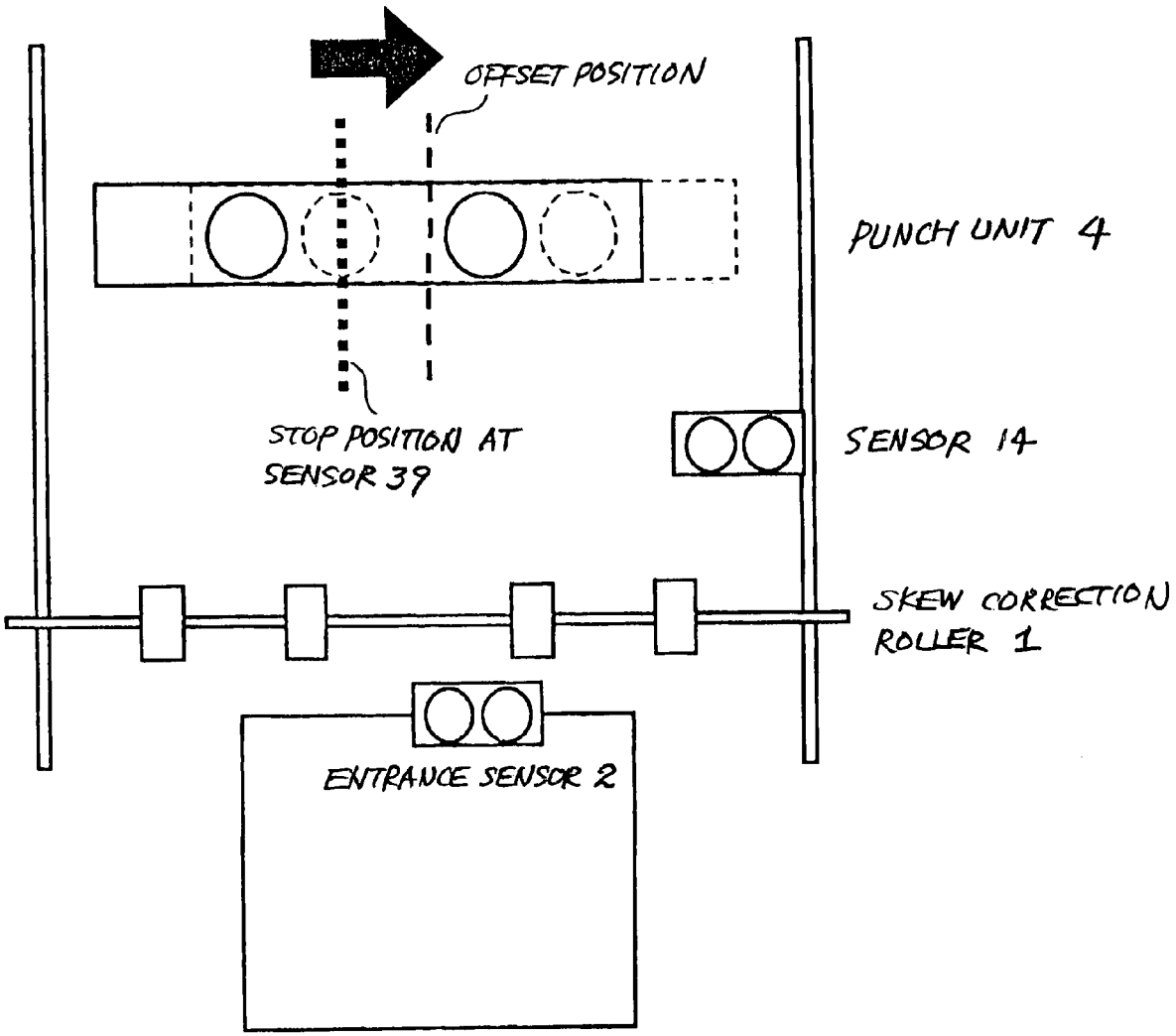
FIG. 11A is a figure for explaining a timing for starting a movement when moving a perforating component in order to offset punching means.
Figure 11B:
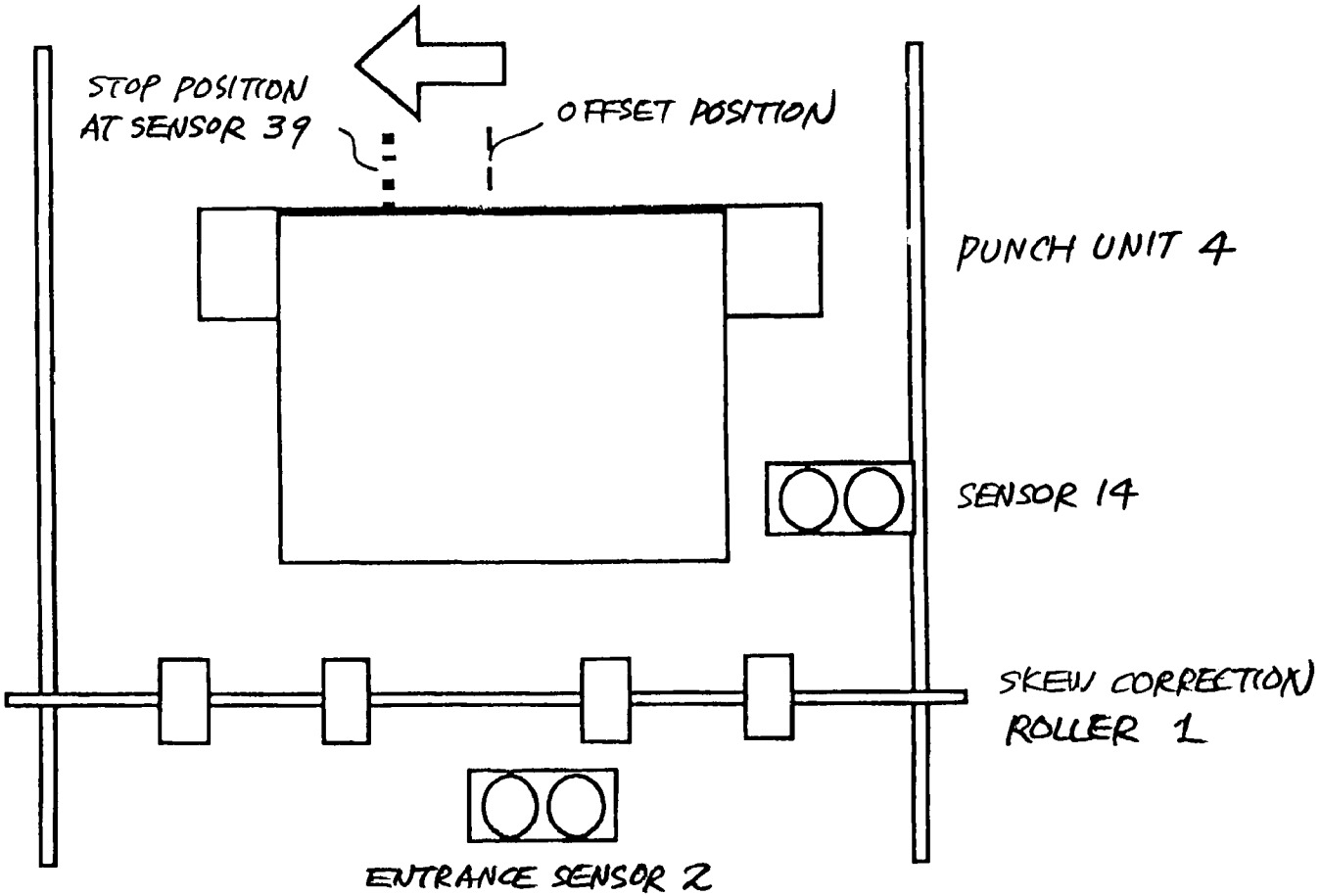
FIG. 11B is a figure for explaining the timing for starting a movement when moving the perforating component in order to prepare for punching holes after offsetting the punching means.

FIG. 11A is a figure for explaining a timing for starting a movement when moving the perforating component F in order to offset the punching means 15. FIG. 11B is a figure for explaining the timing for starting a movement when moving the perforating component F in order to prepare for punching holes after offsetting the punching means 15.

In the case in which a conveyed paper S is in the size by which offsetting can be performed, the paper perforating apparatus of the present embodiment offsets the perforating component F from the position of the home position detector 39 by $\alpha$ mm (to the right direction in FIG. 5. See FIG. 11A). Thereafter, at a point of time when the front of the paper S has passed the perforating component F, the perforating component F is moved to the home position detector 39 again (see FIG. 11B), and the abovementioned perforation preparation is performed.

In this manner, when moving the perforating component from the standby position, the front end of the paper S can be prevented from being caught in the holes of the upper and lower guide plates, and occurrence of jams and curled edges can be avoided.

Figure 12:
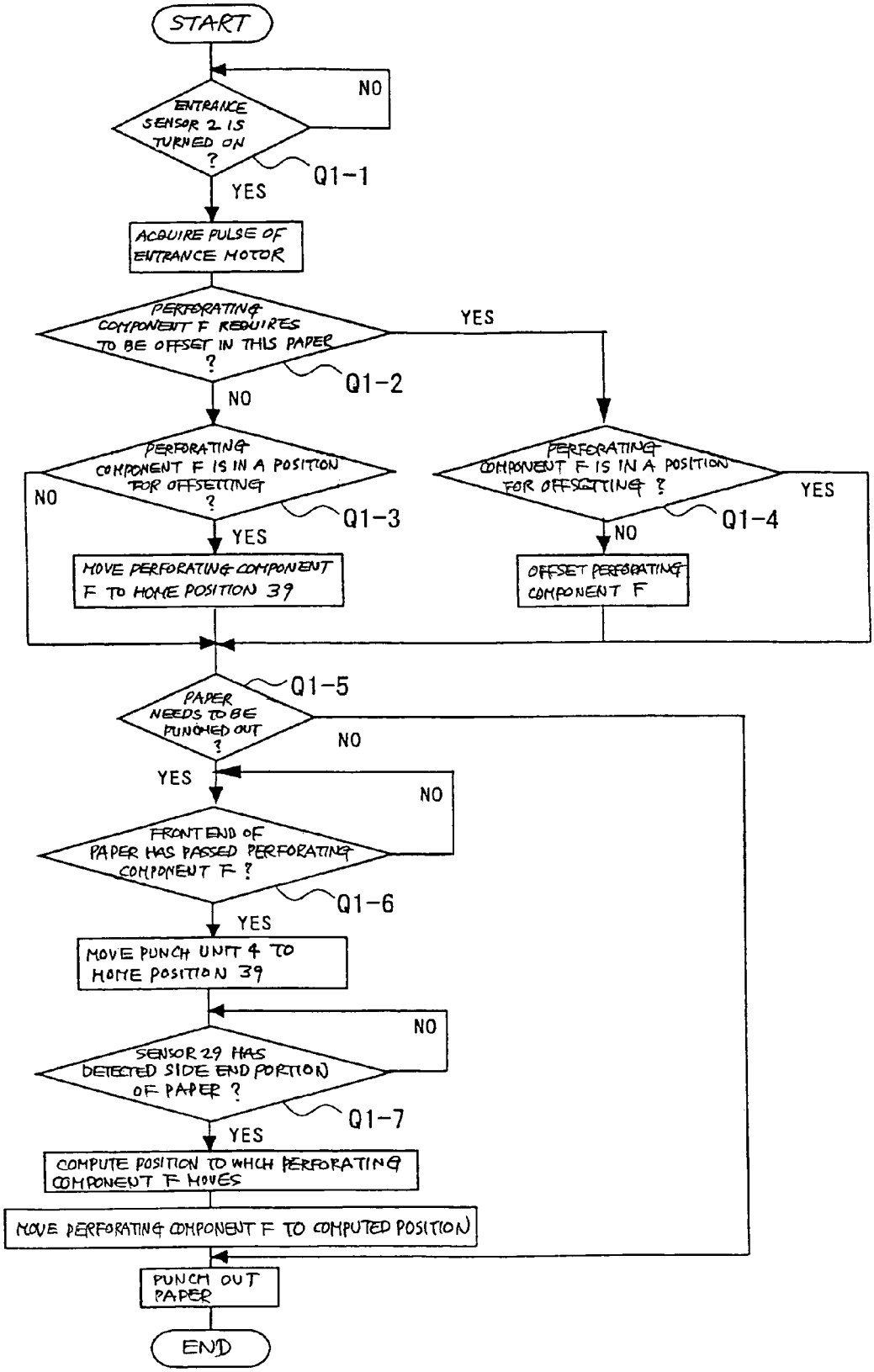
FIG. 12 is a flowchart for explaining a processing procedure of the perforating unit.

FIG. 12 is a flowchart for explaining an example of a processing procedure of the perforating unit 4.

In this processing, first, after confirming that the entrance detector 2 is turned ON (step Q1-1), it is checked whether or not a paper which requires the perforating component F to be offset is used (step Q1-2). If such paper is used, it is checked whether the perforating component F is offset (step Q1-4). If the perforating component F is not in an offset position, the perforating component F is moved to the offset position. If the perforating component F is in the offset position, the next paper is checked whether it is a paper for punching holes (step Q1-5). If this paper is for punching holes, it is confirmed that the front end of the paper has passed the perforating component F (step Q1-6), and thereafter the perforating component F is moved to the position of the home position detector 39. After the perforating component F has been moved to the position of the home position detector 39, it is checked whether or not the detector 29 has detected a side end portion of the paper by means of the paper end portion detector 14 in the horizontal resist detecting unit 3 (step Q1-7). If the detector 29 has detected a paper end portion, the travel distance of the perforating component F is computed on the basis of a result of the detecting operation. After computing the travel distance, the perforating component F is moved to a position away by the computed travel distance, and then punching holes is performed.

It should be noted in the paper perforating apparatus of the present embodiment that if the next paper is for performing an offset operation after perforation is completed, the position of the perforating component F after the perforation is performed is stored, whereby the distance by which the perforating component F should be moved can be computed by a substantial travel position or an original position having the offset amount.

For example, if the position of the perforating component F after perforation is located 8.2 mm away from the home position detector 39, and thereafter needs to be moved by 2.0 mm from the home position detector 39 in order to prevent jams or curled edges of the paper, the perforating component F may be moved toward the home position detector 39 side (to the right, shown with the arrow in FIG. 5) by 8.2 mm−2.0 mm=6.2 mm. In this manner, by moving the perforating component F from the position obtained after perforation directly to the standby position obtained subsequently, the traveling time after perforation can be made short.

Figure 13:
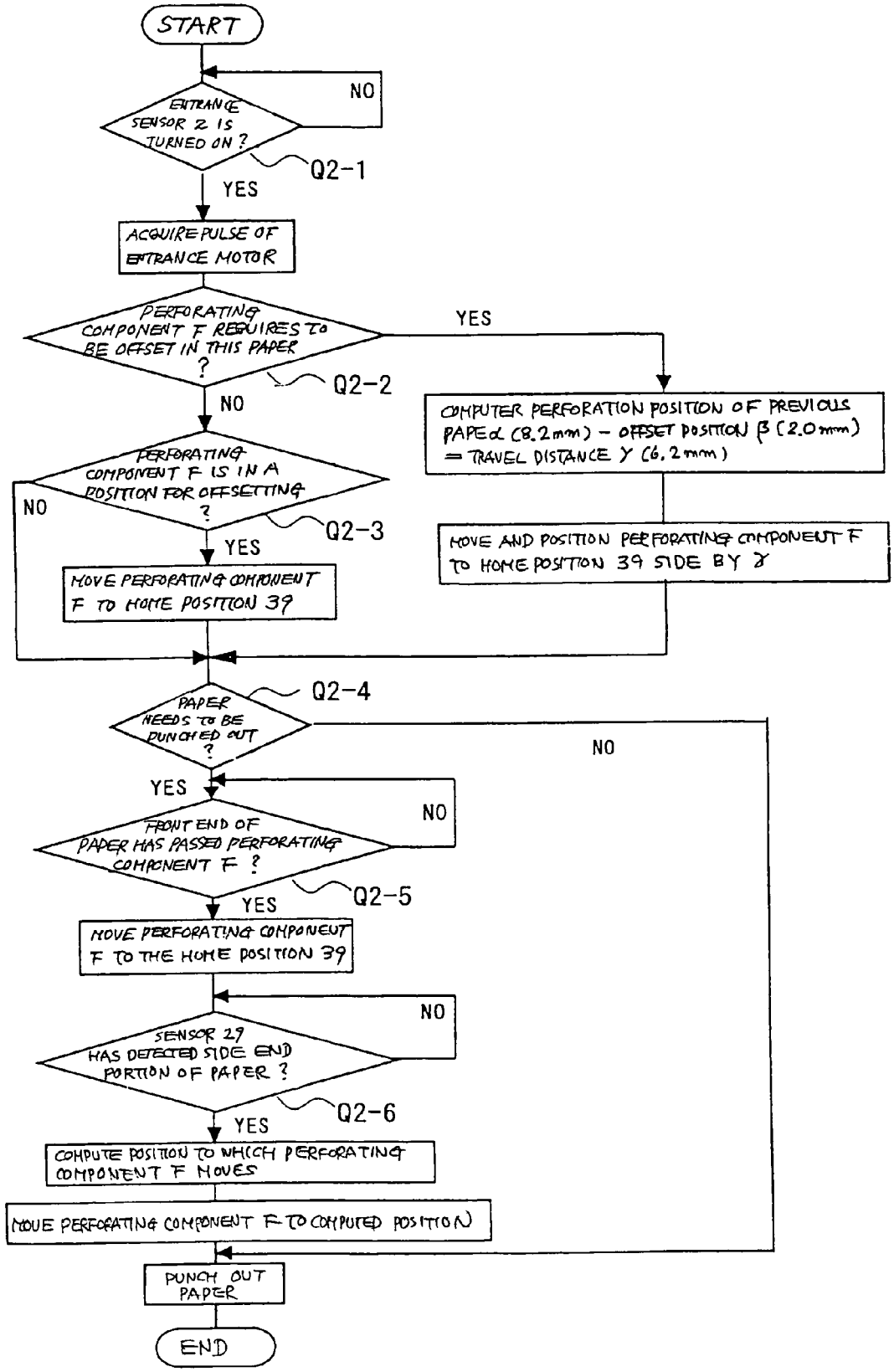
FIG. 13 is a flowchart for explaining a processing procedure of the perforating unit in another embodiment.

FIG. 13 is a flowchart for explaining a processing procedure of the perforating unit 4 in another embodiment.

In this processing as well, as in the processing procedure shown in FIG. 12, first, after confirming that the entrance detector 2 is turned ON (step Q2-1), it is checked whether or not a paper which requires the perforating component F to be offset is used (step Q2-2). If such paper is used, the difference (γ) between the distance from the home position detector 39 to the position of perforation in the previous paper (α), and the distance from the home position detector 39 to the offset position on the next paper (β) is computed, and thereafter the perforating component F is moved to the home position detector 39 side by γ.

It should be noted in the step Q2-2 that, if the paper which requires the perforating component F to be offset is used, it is checked whether the perforating component F is in an offset position (position to which the perforating component F is offset) (step Q2-3). In the step Q2-3, if the perforating component F is in the offset position, the perforating component F is moved to the home position detector 39 side.

After moving the perforating component F to the home position detector 39 side by γ, or to the position of the home position detector 39, it is checked whether or not the next paper is for punching holes (step Q2-4). If this paper is for punching holes, it is confirmed that the front end of the paper has passed the punch unit 4 (step Q2-5), and thereafter the punch unit 4 is moved to the position of the home position detector 39. After the perforating component F has been moved to the position of the home position detector 39, it is checked whether or not the detector 29 has detected a side end portion of the paper by means of the paper end portion detector 14 in the horizontal resist detecting unit 3 (step Q2-6). If the detector 29 has detected a paper end portion, the travel distance of the perforating component F is computed on the basis of a result of the detecting operation. After computing the travel distance, the punch unit 4 is moved to a position away by the computed travel distance, and then punching holes is performed.

Further, as described above, when the offset distance is set to α mm or β mm depending on the size of the paper, in order to perform control information on the size of the paper and information on the travel distance of the punch unit 4 are required. For example, in the case of an A4-size paper, the travel distance is 0 mm, in the case of a B4-size paper, it is 5 mm, and in the case of an A5-size paper, it is −2 mm, thus the mechanism for controlling the punch unit 4 is actually complicated.

Therefore, regarding the travel distance α for the offset operation, the paper perforating apparatus related to a second embodiment of the present invention determines a value of a minimum necessary predetermined distance, which can respond to the punch means attached to the punch unit 4 and to a combination of sizes of conveyable paper, and restricts the position of the punch unit 4, thereby simplifying the control operation. In this case, logically the travel distance of the punch unit 4 may be punch hole diameter+Δα. Note that Δα is the maximum horizontal resist amount of a paper. Specifically, for example, if the punch unit 4 is at the position of the home position detector 39, and that the corners of the paper S in a certain size cam to the holes of the upper and lower guide plates, the corners of the paper can be deviated from the holes of the upper and lower guide plates by moving the paper by the amount larger than the punch hole diameter.

Figure 14:
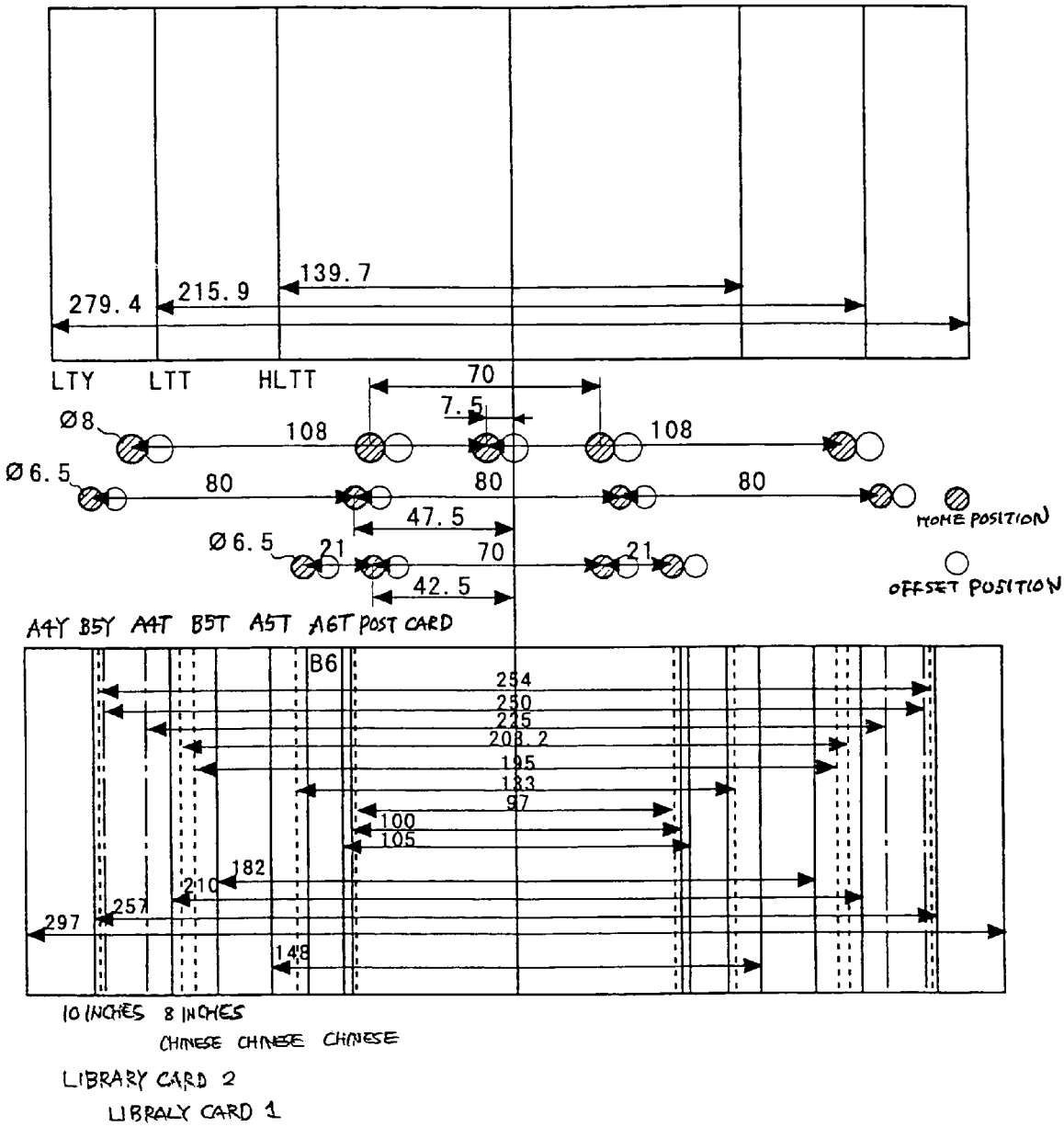
FIG. 14 is a figure showing the positional relationship between each paper size and a punch hole position by destination, when a value of hole diameter+$\Delta\alpha$ is 7.5 mm.

For example, in the second embodiment, the attachable perforating apparatus (for example, North America b 2-hole or 3-hole punching, or 2-hole punching of this country) 4 is compared to the size of a transferable paper, and the standby position of the perforating component F of the punch unit 4 is set to either "the position of the home position detector 39" or "the position obtained by offsetting by hole diameter+Δα," whereby the control operation is simplified. FIG. 14 is a figure showing the positional relationship between each paper size and a punch hole position by destination, when a value of "hole diameter+Δα" is 7.5 mm.

It should be noted in the present embodiment that two positions are indicated as the standby position of the punch unit 4; however, if it is difficult to specify two positions for the standby position, or when increasing certainty in the configuration of the apparatus, three or more positions can be formed as the standby position.

Moreover, in the present embodiment, by attaching the detecting means of the perforating component F to the above-mentioned every standby position of the perforating component F of the punch unit 4, the time taken in the perforation preparation can be reduced.

There is described hereinafter a configuration of operation when, for example, the standby position of the perforating component F, which is described in the above second embodiment, is set to two of either "the position of the home position detector 39" or "the position obtained by offsetting by hole diameter+Δα (position of a detector 40 in which the perforating component is moved by 7.5 mm)."

Figure 15:
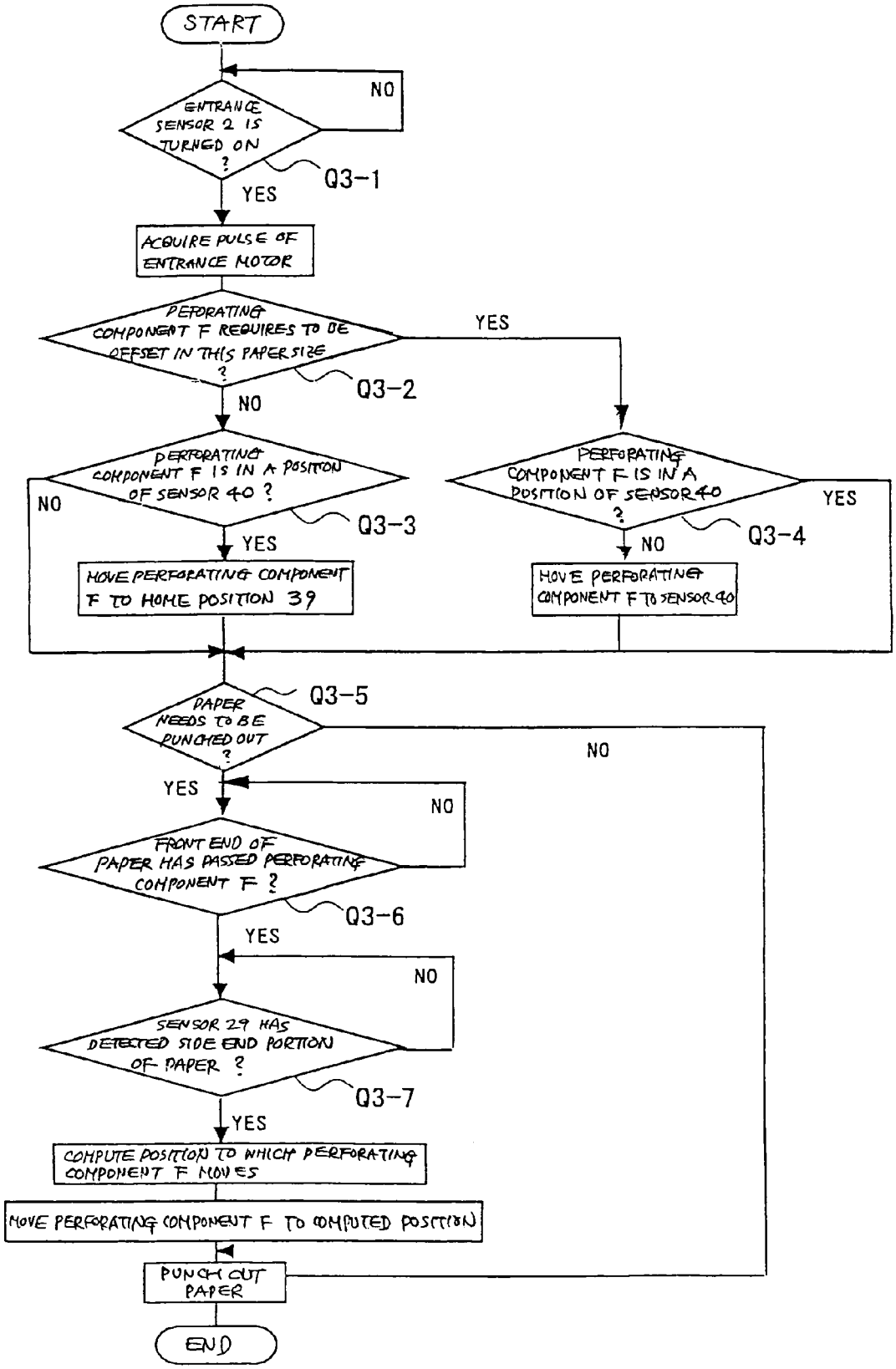
FIG. 15 is a flowchart showing an operation related to a second embodiment of the perforating unit according to the present invention.
Figure 16:
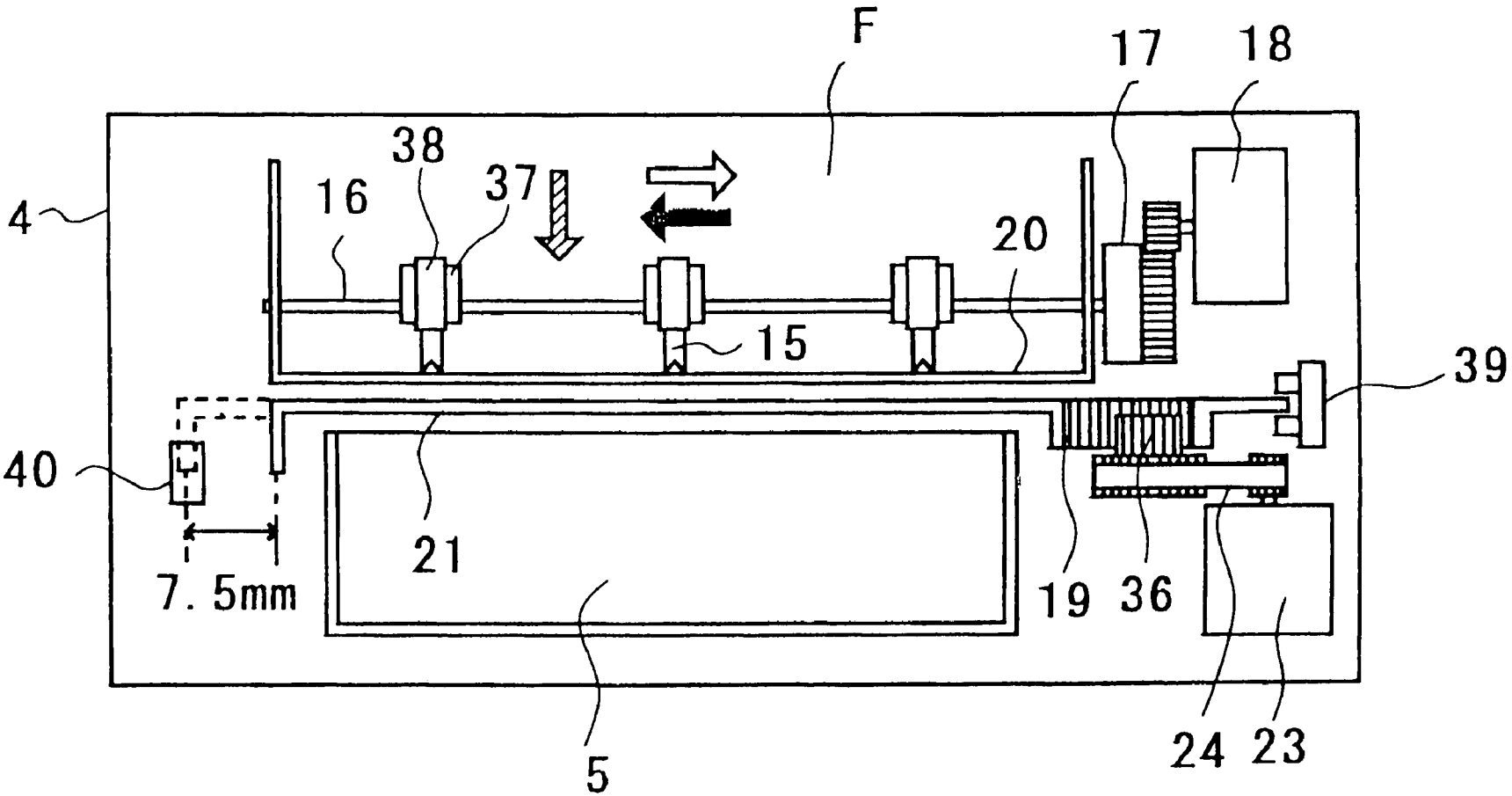
FIG. 16 is a figure for explaining perforated hole position adjustment and an operation of perforation according to the second embodiment.

FIG. 15 is a flowchart showing an operation related to the perforating unit 4 according to the second embodiment, and FIG. 16 is a figure for explaining perforated hole position adjustment and an operation of perforation according to the perforating unit 4.

In the above-described first embodiment shown in FIG. 5, when the perforating component F is in a position to which it is offset from the home position detector 39 by 7.5 mm, at a point of time when the front of the paper S has passed the perforating means 15 which is included in the perforating component, the perforating component was moved again to the position of the home position detector 39.

On the other hand, in the case of using the punch unit 4 related to the second embodiment shown in FIG. 16, the position to which the perforating component is offset by 7.5 mm is provided with the detector 40 as the detecting means of the perforating component F, thus the travel distance of the perforating component can be obtained by means of the information on the position of the paper which is obtained by the detector 29 and the distance between the detector 40 and the detector 39, without bringing the performing component to the position of the home position detector 39. Specifically, a position at which the perforating component F should be present when performing perforation is determined by the detector 29, and the position at which the perforating component F is present at that moment is determined by the detector 40. Accordingly, the perforating component F can be moved directly from the position of the detector 40, and he time taken in the perforation preparation can be reduced.

The processing procedure of the perforated hole position adjustment and the operation of perforation according to the second embodiment of the perforating unit 4 shown in FIG. 16 is explained using the flowchart of FIG. 15.

First of all, after confirming that the entrance detector 2 is turned ON (step Q3-1), it is checked whether or not a paper which requires the perforating component F to be offset is used (step Q3-2).

If such paper is used, it is checked whether the perforating component F is in the position of the detector 40, which is an offset position (step Q3-4). If the perforating component F is not in the position of the detector 40 which is the offset position, the perforating component F is moved to the position of the detector 40.

It should be noted in the step Q3-2 that, if the paper which requires the perforating component F to be offset is used next, it is checked whether the perforating component F is in the position of the detector 40 (step Q3-3). If the perforating component F is in the position of the detector 40, the perforating component F is moved to the position of the home position detector 39.

After moving the perforating component F to the position of the home position 39 or the position of the detector 40 (offset position), it is checked whether or not the next paper is for punching holes (step Q3-5).

If this paper is for punching holes, it is confirmed that the front end of the paper has passed the punch unit 4 (step Q3-6), and thereafter it is checked whether or not the detector 29 has detected a side end portion of the paper by means of the paper end portion detector 14 in the horizontal resist detecting unit 3 (step Q3-7). If the detector 29 has detected a paper end portion, the travel distance of the perforating component F is computed on the basis of a result of detecting the paper end portion, which is performed by the detector 29 (information on the position in which the perforating means 15 should be present when the perforation is performed), and also a result of detecting the position of the perforating unit 4, which is performed by the detector 40 (a position in which the punch unit 4 is present at the time). After computing the travel distance, the perforating component F is moved to a position away by the computed travel distance, and then punching holes is performed.

For example, if it is determined that the position to which the perforating component should be moved is positioned 3.5 mm away from the home position detector 39 according to the information on the position of the paper, which is obtained by the detector 29, in the case in which the perforating component F stands by in "a position to which the perforating component is offset by hole diameter+$\Delta\alpha$(7.5 mm) (position of the detector 40)" at the present moment, the perforated component F may be moved from the detector 40 to the home position detector 39 side (to the right shown with an arrow in FIG. 16) by 7.5 mm−3.5 mm=4.0 mm. The same processing mechanism as the above processing mechanism is applied in the case in which a plurality of standby positions of the punch unit 4 are provided. The time taken in the perforation preparation can be reduced.

It should be noted that the detector 40 as the detecting means of the perforating component F in the punch unit 4 as shown in FIG. 15 is not only used in the second embodiment which limits the travel position of the perforating component F after being offset, thus the detector 40 can be used in an embodiment in which the perforation operation is performed without limiting the travel position of the perforating component F after being offset.

The operation of the paper finisher FR related to the present invention has been described hereinabove. The accuracy of lining the punch holes is improved by going through the above-described steps, and after performing the perforation processing, the subsequent finishing processing is followed.

Specifically, various finishing processes are carried out, the processes including a shift mode in which the pair of conveyance rollers 7 shown in FIG. 1 and FIG. 2 are passed and papers are stacked on the catch tray 9 by a pair of discharge rollers 8, and a stapling mode in which papers conveyed to a pair of conveyance rollers 10 by the branch nails and pass a pair of staple discharge rollers 11, and then the papers stacked inside the stapling processing tray 12 are stabled with the stapler 13. Moreover, chads dislodged from the punched papers are stored in the hopper 5 shown in FIG. 3 and FIG. 5.

As described above, in the paper perforating apparatus of the present invention, the standby position of the perforating means can be set to a position which does not overlap with an edge of a paper parallel to the paper conveyance direction, and is further set afterwards, thus a front end portion of the paper can be prevented from being caught in the punch holes when standing by the standby position, and occurrence of jams and curled edges can be prevented.

Various modifications will become possible for those skilled in the art after receiving the teachings of the present disclosure without departing from the scope thereof.

What is claimed is:

1. A paper perforating apparatus, comprising:

means for conveying a paper;

means for perforating the paper conveyed by the means for conveying;

means for detecting an end portion parallel to a conveyance direction of the paper conveyed by the means for conveying; and means for moving the means for perforating in a direction perpendicular to the conveyance direction based on a distance computed based on the end portion detected by the means for detecting, wherein the paper perforating apparatus offsets by a predetermined distance a standby position of the means for perforating, which is in the direction perpendicular to the conveyance direction, from a position in which holes are punched out on the paper, the means for perforating starts an operation of perforation preparation from the standby position after a front end of the paper, which is perpendicular to the conveyance direction, passes the means for perforating, and the means for moving moves the means for perforating from the standby position to a home position based on the distance, after the front end of the paper passes the means for perforating.

2. The paper perforating apparatus as claimed in claim 1, wherein the means for perforating changes a direction and a distance in which the standby position is offset, in accordance with a type of a punch hole of the paper and a size of the paper.

3. The paper perforating apparatus as claimed in claim 1, further comprising:

paper detecting means for detecting that the paper conveyed by the means for conveying has reached an upstream location of the paper perforating apparatus, and for judging a necessity of offsetting the means for perforating when the paper reaches the paper detecting means.

4. The paper perforating apparatus as claimed in claim 1, further comprising:

means for storing a standby position of the means for perforating after a perforation; and means for computing a difference between the stored position and a position to which the means for perforating is moved after the perforation, wherein the paper perforating apparatus is configured to move the means for perforating from the stored position to a next standby position, based on the difference.

5. The paper perforating apparatus as claimed in claim 1, wherein the means for perforating moves from the standby position to a new standby position that is provided separately from the home position after the front end of the paper passes the means for perforating.

6. The paper perforating apparatus as claimed in claim 1, wherein the means for perforating takes a position to which the means for perforating moves from the standby position as a perforation position for the next paper after the front of the paper passes the means for perforating.

7. The paper perforating apparatus as claimed in claim 1, wherein the paper perforating apparatus determines the standby position of the means for perforating at the time when the front of the paper reaches the means for perforating in a minimum necessary number of places.

8. The paper perforating apparatus as claimed in claim 7, further comprising:

means for detecting a standby position of the means for perforating, in every standby position of the means for perforating.

9. The paper perforating apparatus as claimed in claim 8, wherein the paper perforating apparatus compares the standby position of the means for perforating, which is detected by the means for detecting a standby position, with a perforation forming position determined by the size of the paper, when performing the perforation operation preparation after the front of the paper passes the means for perforating, and moves the means for perforating from the standby position to the perforation forming position based on the difference between the standby position and the perforation forming position.

10. A paper finisher, comprising:

a paper perforating apparatus, the paper perforating apparatus including:

means for conveying a paper;

means for perforating the paper conveyed by the means for conveying;

means for detecting an end portion parallel to a conveyance direction of the paper conveyed by the means for conveying; and means for moving the means for perforating in a direction perpendicular to the conveyance direction based on a distance computed based on the end portion detected by the means for detecting, wherein the paper perforating apparatus offsets by a predetermined distance a standby position of the means for perforating, which is in the direction perpendicular to the conveyance direction, from a position in which holes are punched out on the paper, the means for perforating starts an operation of perforation preparation from the standby position after a front end of the paper, which is perpendicular to the conveyance direction, passes the means for perforating, and the means for moving moves the means for perforating from the standby position to a home position based on the distance, after the front end of the paper passes the means for perforating.

11. An image forming apparatus, comprising:

an image supporting body configured to support a latent image;

means for charging a surface of the image supporting body;

means for exposing the charged surface of the image supporting body to light based on image data, and for writing an electrostatic latent image;

means for supplying a toner to the electrostatic latent image formed on the surface of the image supporting body and making the electrostatic latent image visible;

means for transferring the visible image formed on the surface of the image supporting body to a transferred body; and a paper finisher having a paper perforating apparatus, the paper perforating apparatus having means for conveying a paper;

means for perforating the paper conveyed by the means for conveying;

means for detecting an end portion parallel to a conveyance direction of the paper conveyed by the means for conveying; and means for moving the means for perforating in a direction perpendicular to the conveyance direction based on a distance computed based on the end portion detected by the means for detecting, wherein the paper perforating apparatus offsets by a predetermined distance a standby position of the means for perforating, which is in the direction perpendicular to the conveyance direction, from a position in which holes are punched out on the paper, and the means for perforating starts an operation of perforation preparation from the standby position after a front end of the paper, which is perpendicular to the conveyance direction, passes the means for perforating, and the means for moving moves the means for perforating from the standby position to a home position based on the distance, after the front end of the paper passes the means for perforating.

12. A paper perforating apparatus, comprising:

a conveying unit configured to convey a paper;

a perforating unit configured to perforate the paper conveyed by the conveying unit;

a detection unit configured to detect an end portion parallel to a conveyance direction of the paper conveyed by the conveying unit; and a moving unit configured to move the perforating unit in a direction perpendicular to the conveyance direction based on a distance computed based on the end portion detected by the detection unit, wherein the paper perforating apparatus offsets by a predetermined distance a standby position of the perforating unit, which is in the direction perpendicular to the conveyance direction, from a position in which holes are punched out on the paper, the perforating unit is configured to start an operation of perforation preparation from the standby position after a front end of the paper, which is perpendicular to the conveyance direction, passes the perforating unit, and the moving unit is configured to move the perforating unit from the standby position to a home position based on the distance, after the front end of the paper passes the perforating unit.

13. The paper perforating apparatus as claimed in claim 12, further comprising:

a detecting unit configured to detect that the paper conveyed by the conveying unit has reached an upstream location of the paper perforating apparatus, and to judge a necessity of offsetting the perforating unit when the paper reaches the detecting unit.

14. The paper perforating apparatus as claimed in claim 12, further comprising:

a unit configured to store a standby position of the perforating unit after a perforation; and a unit configured to compute a difference between the stored position and a position to which the perforating unit is moved after the perforation, wherein the paper perforating apparatus is configured to move the perforating unit from the stored position to a next standby position, based on the difference.

15. The paper perforating apparatus as claimed in claim 12, wherein the perforating unit moves from the standby position to a new standby position that is provided separately from the home position after the front end of the paper passes the perforating unit.

16. A method, comprising:

conveying a paper;

perforating the conveyed paper with a perforation device;

detecting an end portion parallel to a conveyance direction of the conveyed paper;

moving the perforation device, using a moving device, in a direction perpendicular to the conveyance direction based on a distance computed based on the detected end portion;

offsetting a standby position of the perforation device by a predetermined distance from a position in which holes are punched out on the paper, the standby position is in the direction perpendicular to the conveyance direction;

starting an operation of perforation preparation from the standby position after a front end of the paper, which is perpendicular to the conveyance direction, passes the perforation device; and moving the perforation device with the moving device from the standby position to a home position based on the distance, after the front end of the paper passes the perforation device.

17. The method as claimed in claim 16, further comprising:

detecting that the conveyed paper has reached an upstream location including the perforation device; and judging a necessity of offsetting the perforation device when it is detected that the conveyed paper has reached the upstream location.

18. The method as claimed in claim 16, further comprising:

storing a standby position of the perforation device after a perforation;

computing a difference between the stored position and a position to which the perforation device is moved after the perforation; and moving the perforation device from the stored position to a next standby position, based on the difference.

19. The method as claimed in claim 16, further comprising:

moving the perforation device from the standby position to a new standby position that is provided separately from the home position after the front end of the paper passes the perforation device.

* * * * *